US006714754B2

(12) United States Patent
Ozeki et al.

(10) Patent No.: US 6,714,754 B2
(45) Date of Patent: Mar. 30, 2004

(54) DEVELOPING ROLLER FOR ELECTROPHOTOGRAPHY, DEVELOPING APPARATUS, APPARATUS UNIT AND IMAGE FORMING APPARATUS

(75) Inventors: Yukihiro Ozeki, Kanagawa-ken (JP); Katsuhiro Sakaizawa, Shizuoka-ken (JP); Makoto Nonomura, Kanagawa-ken (JP); Manami Sekiguchi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/245,372

(22) Filed: Sep. 18, 2002

(65) Prior Publication Data

US 2003/0016967 A1 Jan. 23, 2003

Related U.S. Application Data

(62) Division of application No. 09/643,423, filed on Aug. 22, 2000.

(30) Foreign Application Priority Data

Aug. 24, 1999 (JP) ..... 11-236911

(51) Int. Cl.[7] ..... G03G 15/08
(52) U.S. Cl. ..... 399/286; 492/28
(58) Field of Search ..... 399/286, 279; 492/28

(56) References Cited

U.S. PATENT DOCUMENTS

| | | | | |
|---|---|---|---|---|
| 5,099,286 A | | 3/1992 | Nishise et al. | 355/272 |
| 5,597,652 A | | 1/1997 | Utsunomiya et al. | 428/382 |
| 5,867,755 A | | 2/1999 | Sato | 399/149 |
| 6,035,172 A | | 3/2000 | Mimura et al. | 399/286 |
| 6,070,041 A | | 5/2000 | Nakayasu et al. | 399/301 |
| 6,376,087 B1 | | 4/2002 | Ozeki et al. | 428/447 |
| 6,484,007 B1 | * | 11/2002 | Ozeki et al. | 399/286 |

FOREIGN PATENT DOCUMENTS

| | | |
|---|---|---|
| EP | 0 911 704 A1 | 4/1999 |
| JP | 63-212944 | 9/1988 |
| JP | 5-72883 | 3/1993 |
| JP | 10-3210 | 1/1998 |
| JP | 10-333422 | 12/1998 |
| WO | WO 99/24487 | 5/1999 |

OTHER PUBLICATIONS

Patent Abstract of Japan, Pub. No. 63212944.

* cited by examiner

*Primary Examiner*—Quana M. Grainger
(74) *Attorney, Agent, or Firm*—Fitzpatrick, Cella, Harper & Scinto

(57) ABSTRACT

A developing roller for electrophotography is disclosed which is composed of a conductive mandrel, a charge-providing layer having a charge-providing performance to a non-magnetic one-component toner, formed at the surface of the roller, a base layer having an elasticity, formed at a position nearer to the mandrel of the roller than the charge-providing layer and an elastic intermediate layer formed at a position between the base layer and the charge-providing layer. The elastic intermediate layer is formed of a composition having a contact angle to water which is smaller than that of a composition for forming the base layer. Also, disclosed are a developing apparatus, an apparatus unit and an image forming apparatus using the developing roller.

115 Claims, 7 Drawing Sheets

DEVELOPING ROLLER FOR ELECTROPHOTOGRAPHY, DEVELOPING APPARATUS, APPARATUS UNIT AND IMAGE FORMING APPARATUS

This is a divisional application of application Ser. No. 09/643,423, filed Aug. 22, 2000.

BACKGROUND OF THE INVENTION

1. Field of the Invention

This invention relates to a developing apparatus for developing an electrostatic latent image formed on an image bearing member, by adhering thereto a non-magnetic one-component toner formed in thin layer on a developing roller to render the electrostatic latent image visible as a toner image; a developing roller for electrophotography used in the developing apparatus; and an apparatus unit and an image-forming apparatus which make use of such a developing roller.

2. Related Background Art

As developers used in electrophotographic developing apparatus for forming black-and-white images, toners endowed with magnetic properties and comprised of a single component (magnetic one-component toners) are conventionally used. Toners having magnetic properties, however, are not suited for color toners. Accordingly, in currently available electrophotographic developing apparatuses for forming color images, toners having no magnetic properties and comprised of a single component (non-magnetic one-component toners) are chiefly used.

Electrophotographic developing apparatus are constructed in a little different ways depending on the types of toners used. In particular, the way in which the toner is carried on the surface of a developing roller (developer-carrying member) differs depending on whether toners are magnetic or non-magnetic. More specifically, in the case when the magnetic one-component toners are used, a magnet is provided within the developing roller so that the toner can be carried, and transported, on the developing roller chiefly by the aid of a magnetic force. On the other hand, in the case when the non-magnetic one-component toners, having no magnetic properties and comprised of a single component, the toner must be carried, and transported, on the surface of the developing roller chiefly by the charging of toner itself, in place of the magnetic force, by the aid of image force which is Coulomb force acting between electric charges on the toner and those generated on the roller surface by the charging. Accordingly, in the case when the non-magnetic one-component toner is used, the magnet is no longer required but instead a means by which the charge quantity necessary for producing the image force is imparted to the toner is required to make the toner carried on the developing roller.

As a commonly available example of a conventional electrophotographic developing apparatus making use of a non-magnetic one-component toner, a contact type developing apparatus is shown in FIG. 4.

As shown in FIG. 4, a developing apparatus 101 has a developing roller 102 which comes into contact with a photosensitive drum (image bearing member) 100 rotated in the direction of X in the drawing to perform development while being rotated in the direction of Y in the drawing, a toner feed roller 104 which is rotated in the direction of Z to feed a non-magnetic one-component toner T' to the developing roller 102, a developing blade (toner regulation means) 103 which regulates the quantity of the toner T' to be coated on the developing roller 102 and the charge quantity thereof, and an agitating member 105 which agitates the toner T' and also feeds it to the toner feed roller 104. In a contact type developing apparatus in which the photosensitive drum 100 is a rigid body and which performs development while bringing this drum and the developing roller 102 into contact with each other in the zone shown by S in FIG. 4, the developing roller 102 may preferably be a roller having an elasticity so that the photosensitive drum 100 and the developing roller 102 can be in close contact without any gap between them. In a developing apparatus having a developing roller 102 formed of a resin which is an elastic material, a developing blade 103 made of a metal, having a good performance of charging by friction, may preferably be used in order to control the quantity of charge to the non-magnetic one-component toner T'.

In the developing apparatus 101, a DC component development bias is applied to the developing roller 102 from a power source (not shown) to form a development potential at the developing zone lying between the photosensitive drum 100 and the developing roller 102, whereby the toner T' is caused to adhere to the surface of the photosensitive drum 100. More specifically, the toner T' having been charged adheres to the surface of the photosensitive drum 100 by the aid of Coulomb force, in a pattern corresponding to an electrostatic latent image formed on the surface of the photosensitive drum 100 by an exposure means (not shown), and the electrostatic latent image is rendered visible as a toner image to effect development. The toner having not participated in the development and remained on the surface of the developing roller 102 is taken off by the toner feed roller 104 and is collected in the developing apparatus 101.

This developing apparatus 101 uses an insulating non-magnetic one-component toner basically. For this toner T' to be carried and transported on the developing roller 102, it is necessary to charge the toner T' to produce the image force between the toner T' and the developing roller 102.

Now, a method of carrying the toner T' on the developing roller 102 will be more detailed below. The toner feed roller 104 feeds the toner T' to the developing roller 102 and also triboelectically charge the toner T' at the contact nip zone between this developing roller 102 and the toner feed roller 104. More specifically, as the toner feed roller 104 is rotated, the toner T' is guided to the contact nip zone between the developing roller 102 and the toner feed roller 104, and is charged by its friction with the developing roller 102. As the result, the charge quantity necessary for producing the image force by the aid of which the toner T' is carried on the developing roller 102 is imparted to the toner T'. In that course, the quantity of the toner T' to be fed to the developing roller 102 is controlled by appropriately setting a difference in peripheral speed between the developing roller 102 and the toner feed roller 104.

In an image-forming apparatus where the above conventional developing apparatus is used, a spherical toner T' having a uniformly round particle shape has come to be used in order to make reproduced images have a high quality. More specifically, when the toner T' has an uneven particle shape as in the case of pulverization toners conventionally used, particles having different shapes move in different ways at the time of development, and hence part of the toner T' may scatter and may adhere to non-image areas (to cause a phenomenon of what is called fog). Use of spherical toner T' can make such an inconvenience less occur.

The pulverization toners have so high a frictional force of toner itself that, even when the developing roller 102 is constituted of a silicone rubber single layer as shown in FIG. 5, the intended charge quantity can be obtained by its friction with such a silicone rubber surface layer. When, however, the toner T' is made to have a spherical particle shape, the toner T' itself has a low frictional force, so that the charge quantity to be obtained by the friction between the toner T' and the silicone rubber surface layer may lower to make it difficult to obtain the intended charge quantity.

A toner T' having a core/shell structure encapsulating a wax having a low melting temperature also has come to be used in order to reduce heat energy required in the step of permanently fixing toner images transferred to a recording medium surface (to achieve what is called energy-saved fixing).

A spherical toner T' having such wax-encapsulated core/shell structure tends to deteriorate because of stress. Accordingly, it has become necessary to lower the hardness of the developing roller 102 and further to lower the coefficient of dynamic friction of the developing roller 102 surface so that the spherical toner T' deteriorates less. This has made it more difficult to obtain the desired toner charge quantity.

The coefficient of dynamic friction of the developing roller 102 surface must be made low for the following reason. Where the developing roller 102 has a low hardness, in particular, an Asker-C hardness of about 40 degrees or lower as measured with Asker-C Hardness Meter (trade name; manufactured by Kohbunshi Keiki K.K.), the developing roller 102 may vibrate at the contact zone between the developing roller 102 and the photosensitive drum 100 if the developing roller 102 has a high coefficient of dynamic friction at the surface, so that the toner T' carried thereon may scatter and this effect may appear on reproduced images, resulting in a very low image quality. In order to prevent this, the surface of the developing roller 102 must be made to have a low coefficient of dynamic friction. Here, this problem can be eliminated if the developing roller 102 is made to have a high hardness, e.g., a high hardness of about 45 degrees as hardness prescribed in JIS A, but resulting in a great deterioration of the spherical toner T'.

Accordingly, in place of the developing roller 102, it has become necessary to use, as shown in FIG. 6, a developing roller 112 having a charge-providing layer 112*d* having a low coefficient of dynamic friction and also having a high charge-providing performance to the spherical toner T', formed on the roller surface. According to studies made by the present applicants, as materials for this charge-providing layer 112*d*, resin materials capable of charging the toner T' negatively by triboelectric charging with the toner T' and being positively chargeable in and of themselves, as typified by acrylic urethane resins, acrylic polyester urethane resins and polyamide resins. As materials for a base layer 112*b* of the developing roller 112, silicone rubber is used, as having good rubber properties, e.g., a high durability and a low compression set.

In order to form an electric field across the photosensitive drum 100 surface and the developing roller 112 surface, the developing roller 112 must be made conductive across a mandrel 112*a* and the surface layer of the developing roller 112. Accordingly, as a developing roller 112 in which conductive particles such as metal oxide particles or carbon particles are dispersed in an appropriate quantity in the chief component of roller constituent members to have a conductivity, a roller having a net resistivity (resistivity across the mandrel 112*a* and the developing roller 112 surface) of commonly about $10^4$ Ω to $10^9$ Ω is used.

Here, if the charge-providing layer 112*d* has a high resistivity, the toner T' having adhered to the charge-providing layer 112*d* has a large image force acting on electric charges generated by charging, and the toner T' may adhere to the charge-providing layer 112*d* surface strongly, so that the toner T' may come away from the developing roller 112 surface with difficulty. For example, if the charge-providing layer 112*d* has a volume resistivity of about $10^{10}$ Ω·cm or above, the toner T' having not participated in the development is not taken off even though it has reached the toner feed roller 104, so that the toner T' having remained on the developing roller 112 surface many times passes the contact nip zone between the toner feed roller 104 and the developing roller 112 and the contact nip zone between the developing blade 103 and the developing roller 112. As a result of friction at these contact nip zones, the toner T' is further charged up to become difficult for itself to participate in development, resulting in a decrease in density of reproduced images. Also, even if the toner T' was taken off from the developing roller 112 surface, electric charges are accumulated in the high-resistance charge-providing layer 112*d* to block the feeding of any fresh toner T'. As the result, the toner T' adhering to the developing roller 112 surface may decrease to cause a decrease in density of reproduced images.

If the charge-providing layer 112*d* is made to have a resistivity of about $10^9$ Ω·cm or above in normal environment, any changes in temperature and humidity tends to cause changes in the conductivity because of a low density of the conductive particles which are dispersed in the chief component in order to provide the conductivity. Hence, the resistivity of the charge-providing layer 112*d* tends to be affected by the temperature and humidity, so that the resistivity may vary about ten to about hundred times because of environmental changes. For example, there is a possibility that those having a resistivity of about $10^9$ Ω·cm in normal environment come to have a resistivity of about $10^{10}$ Ω·cm in an environment of low humidity, and about $10^8$ Ω·cm in an environment of high humidity.

Hence, the upper-limit value of volume resistivity of the charge-providing layer 112*d* is about $10^8$ Ω·cm.

As for the lower-limit value of volume resistivity of the charge-providing layer 112*d*, it is determined as a value at which the developing roller 102 can be prevented from being adversely affected by the flowing of electricity to the photosensitive drum 100 surface, and there is no problem as long as it is a volume resistivity of about $10^4$ Ω·cm or above.

More specifically, as the resistivity of the charge-providing layer 112*d*, a resistivity of approximately from $10^4$ Ω·cm to $10^8$ Ω·cm in volume resistivity is suitable.

In order to form the charge-providing layer 112*d* on the surface layer of the base layer 112*b*, an adhesive 112*c* is required for bonding the both layers because the silicone rubber layer has a low surface energy. In general, as this adhesive 112*c*, an amino type silane coupling material is used, and it is coated in a thickness of about 1 μm or smaller.

The developing roller 112 must be endowed with conductivity across the mandrel 112*a* and the surface layer of the developing roller 112 as mentioned previously. The adhesive 112*c*, however, is in so small a coating weight that it little affects the net resistivity of the developing roller 112 even without being made conductive. More specifically, the conductivity can be imparted across the mandrel 112*a* and the developing roller 112 surface as long as the conductivity is imparted to the charge-providing layer 112*d* and the base layer 112*b*. For example, where the charge-providing layer

112*d* and the base layer 112*b* are made to have a volume resistivity of from $10^5$ Ω·cm to $10^6$ Ω·cm, a developing roller 112 having a charge-providing layer 112*d* of few μm to about 50 μm thick and a base layer 112*b* of from about 1 mm to about 5 mm thick have a net resistivity of from about $10^4$ Ω to about $10^5$ Ω when the potential difference between the mandrel 112*a* and the developing roller 112 surface is about 300 V.

However, in the use of such a developing roller 112 having a multi-layer construction, there is the following problem.

As described previously, the developing apparatus shown in FIG. 4 employs a contact developing system, in which the toner T' is caused to adhere to the photosensitive drum 100 while keeping the developing roller 112 in contact with the photosensitive drum 100. Also, in order to obtain a sufficient image density, a difference in peripheral speed is commonly provided between the peripheral speed of the photosensitive drum 100 and the peripheral speed of the developing roller 112. Hence, a frictional force acts between the developing roller 112 and the photosensitive drum 100 at their contact nip zone, and a stress is applied to the developing roller 112. Meanwhile, in the developing roller 112 shown in FIG. 6, the base layer 112*b* is a silicone rubber layer with a low hardness and also the charge-providing layer 112*d* is a resin layer which is harder than the silicone rubber layer. Hence, the amount of deformation due to stress differs between the charge-providing layer 112*d* and the base layer 112*b*, so that a force is applied in the direction where the charge-providing layer 112*d* is peeled from the base layer 112*b*. Moreover, since silicone rubber has properties that it has a low surface energy, there is a problem that the charge-providing layer 112*d* may locally separate from or peel off (i.e., lift) the surface of the base layer 112*b* because of the stress given to the developing roller 112.

If, taking account of the use of the spherical toner T' as described previously, which is weak to stress, the base layer 112*b* is made to have a low hardness (e.g., about 40 degrees or lower as measured with Asker-C Hardness Meter) in order to reduce the stress to the toner T' , a great difference in the amount of deformation may result between the charge-providing layer 112*d* and the base layer 112*b*, so that the former may more tend to separate locally from the latter.

Here, one may contemplate to prevent such local separation or peeling by imparting rubber properties to the charge-providing layer 112*d* so as to absorb the stress. According to studies made by the present applicants, however, the charge-providing layer 112*d* not only is required to have properties that it has a high charge-providing performance to the spherical toner T' , but also must have a low coefficient of surface friction. Hence, it is not suitable to impart rubber properties to the charge-providing layer 112*d*, which provide a high coefficient of surface friction.

Where the charge-providing layer 112*d* has locally separated from the base layer 112*b*, the following problems occur.

A first problem is that the charge-providing layer 112*d* may come off from the surface of the developing roller 112. Once the charge-providing layer 112*d* has come off, for example the charge-providing performance of the developing roller 112 is lost and the photosensitive drum 100 and the developing roller 112 come into faulty contact, to cause extremely faulty images.

A second problem is that the developing roller 112 comes to have a high electrical resistivity. More specifically, where the charge-providing layer 112*d* has locally separated from the base layer 112*b*, a gap is formed between the charge-providing layer 112*d* and the base layer 112*b* at the separated region, and this gap stands resistant to cause an increase in electrical resistivity, resulting in a high net resistivity of the developing roller 112 at that part. Hence, the developing electric field decreases at the separated region, and also the resistance increases at the surface portion of the developing roller 112, and hence it becomes difficult to take off the toner T' from the developing roller 112 surface, resulting in a decrease in density of output images at the part corresponding to the separated region. Moreover, like the case where the charge-providing layer 112*d* has a high resistance, the toner T' may adhere to the developing roller 112 in a small quantity at its surface corresponding to the separated region, resulting in a greater decrease in image density.

The above problems caused by the local separation of the charge-providing layer 112*d* from the base layer 112*b* may become more conspicuous when a developing roller 112 having a low hardness is used. The reason therefor is presumed in the following way.

In the case when the base layer 112*b* has a high hardness, e.g., about 40 degrees as measured with a JIS-A hardness meter, the contact between the developing roller 112 and the photosensitive drum 100 at the contact nip zone is at a relatively high pressure. Hence, where the photosensitive drum 100 stands in contact with the developing roller 112, contact points at which the charge-providing layer 112*d* comes into contact with the base layer 112*b* are formed at the gap portion caused by the local separation between them. At such contact points, the conductivity is restored to make the net resistivity low, and hence any effect caused by the local separation can be smaller than in the case of the low-hardness developing roller. However, the developing roller 112 having this hardness can not be used in the developing apparatus making use of the spherical toner T' which tends to deteriorate.

On the other hand, where the base layer 112*b* has a low hardness, the contact between the developing roller 112 and the photosensitive drum 100 at the contact nip zone is at a low pressure. Hence, the contact points between the charge-providing layer 112*d* and the base layer 112*b* as stated above are in a small number, and hence the effect caused by the local separation is great.

Thus, making the base layer 112*b* have a low hardness tends to cause the local separation of the charge-providing layer 112*d* from the base layer 112*b* and also makes the effects of separation great. In other words, it is difficult to make the developing roller 112 with the charge-providing layer 112*d* have a low hardness.

As discussed in the foregoing, in conventional developing apparatus, it has been difficult to obtain a developing roller 112 which has a base layer 112*b* having a low-hardness and a charge-providing layer 112*d* having a high charge-providing performance and also having a low coefficient of dynamic friction. As the result, in the developing apparatus making use of the non-magnetic one-component toner T' having a low melting point and a spherical particle shape, it has been difficult to obtain a developing roller 112 that can perform development without causing any deterioration of the spherical toner T' and also while carrying the spherical toner T' well.

To solve the problems as discussed above, as disclosed in Japanese Patent Application Laid-open No. 10-3210, a developing roller is provided in which an elastic layer of a conductive rubber comprised of a resin composition, having a contact angle to water of 75 to 85 degrees, is formed around a shaft made of a metal and a surface protective layer comprised of a resin composition composed chiefly of a fluorine resin, having a contact angle to water of 90 degrees or smaller, is formed on the former's layer surface. In this proposal, the adhesion between the conductive rubber elastic layer and the surface protective layer is more improved than the conventional, but the problem of separation of the surface protective layer from the conductive rubber elastic layer has not fundamentally been solved. Thus, in the case when the developing roller is used under such development conditions that the difference in peripheral speed is provided between the developing roller and the photosensitive member as stated previously, and the conductive rubber elastic layer is made to have a low hardness so as to be applicable to the spherical toner, it is sought to make an improvement such that the separation of the surface protective layer from the conductive rubber elastic layer may more hardly occur.

SUMMARY OF THE INVENTION

An object of the present invention is to provide a developing roller for electrophotography the surface of which has so low a coefficient of dynamic friction and so low a hardness as to apply only a low stress to the toner T', also having a high charge-providing performance to the toner, and a developing apparatus, an apparatus unit and an image-forming apparatus which make use of such a developing roller.

To achieve the above object, the present invention provides a developing roller for electrophotography, comprising;

a conductive mandrel;

a charge-providing layer having a charge-providing performance to a non-magnetic one-component toner, formed at the surface of the roller;

a base layer having an elasticity, formed at a position nearer to the mandrel of the roller than the charge-providing layer; and an elastic intermediate layer formed at a position between the base layer and the charge-providing layer;

a composition for forming the elastic intermediate layer having a contact angle to water which is smaller than the contact angle to water of a composition for forming the base layer.

The present invention also provides a developing apparatus comprising;

a toner hopper for holding therein a non-magnetic one-component toner for developing an electrostatic latent image formed on the surface of an image bearing member; and a developing roller for transporting the non-magnetic one-component toner held in the toner hopper, while causing the toner to adhere to the roller surface;

wherein;

the developing roller comprises;

a conductive mandrel;

a charge-providing layer having a charge-providing performance to the toner, formed at the surface of the roller;

a base layer having an elasticity, formed at a position nearer to the mandrel of the roller than the charge-providing layer; and an elastic intermediate layer formed at a position between the base layer and the charge-providing layer; and a composition for forming the elastic intermediate layer has a contact angle to water which is smaller than the contact angle to water of a composition for forming the base layer.

The present invention still also provides an apparatus unit detachably mountable to the main body of an image-forming apparatus, comprising;

a toner hopper for holding therein a non-magnetic one-component toner for developing an electrostatic latent image formed on the surface of an image bearing member; and a developing roller for transporting the non-magnetic one-component toner held in the toner hopper, while causing the toner to adhere to the roller surface;

wherein;

the developing roller comprises;

a conductive mandrel;

a charge-providing layer having a charge-providing performance to the toner, formed at the surface of the roller;

a base layer having an elasticity, formed at a position nearer to the mandrel of the roller than the charge-providing layer; and an elastic intermediate layer formed at a position between the base layer and the charge-providing layer; and a composition for forming the elastic intermediate layer has a contact angle to water which is smaller than the contact angle to water of a composition for forming the base layer.

The present invention further provides an image-forming apparatus comprising;

(I) a plurality of image-forming units each having;

an image bearing member for holding thereon an electrostatic latent image;

a charging assembly for charging the image bearing member primarily;

an exposure assembly for forming the electrostatic latent image on the image bearing member having primarily been charged; and a developing apparatus for developing the electrostatic latent image by the use of a non-magnetic toner to form a toner image; and (II) a transfer assembly for sequentially transferring to a transfer medium the toner images formed in the plurality of the image-forming units;

the developing apparatus comprising;

a toner hopper for holding therein a non-magnetic one-component toner for developing the electrostatic latent image formed on the surface of the image bearing member; and a developing roller for transporting the non-magnetic one-component toner held in the toner hopper, while causing the toner to adhere to the roller surface;

wherein;

the developing roller comprises;

a conductive mandrel;

a charge-providing layer having a charge-providing performance to the toner, formed at the surface of the roller;

a base layer having an elasticity, formed at a position nearer to the mandrel of the roller than the charge-providing layer; and an elastic intermediate layer formed at a position between the base layer and the charge-providing layer; and a composition for forming the elastic intermediate layer has a contact angle to water which is smaller than the contact angle to water of a composition for forming the base layer.

The present invention still further provides an image-forming apparatus comprising;

(I) an image bearing member for holding thereon an electrostatic latent image;

(II) a charging assembly for charging the image bearing member primarily;

(III) an exposure assembly for forming the electrostatic latent image on the image bearing member having primarily been charged;

(IV) a plurality of developing apparatus each for developing the electrostatic latent image by the use of a non-magnetic toner to form a toner image;

(V) an intermediate transfer member for sequentially transferring thereto the toner image formed by each of the developing apparatus; and (VI) a transfer assembly for transferring to a transfer medium at one time a multiple toner image transferred to the intermediate transfer member;

the developing apparatus comprising;

a toner hopper for holding therein a non-magnetic one-component toner for developing the electrostatic latent image formed on the surface of the image bearing member; and a developing roller for transporting the non-magnetic one-component toner held in the toner hopper, while causing the toner to adhere to the roller surface;

wherein;

the developing roller comprises;

a conductive mandrel;

a charge-providing layer having a charge-providing performance to the toner, formed at the surface of the roller;

a base layer having an elasticity, formed at a position nearer to the mandrel of the roller than the charge-providing layer; and an elastic intermediate layer formed at a position between the base layer and the charge-providing layer; and a composition for forming the elastic intermediate layer has a contact angle to water which is smaller than the contact angle to water of a composition for forming the base layer.

The present invention still further provides an image-forming apparatus comprising;

(I) an image bearing member for holding thereon an electrostatic latent image;

(II) a charging assembly for charging the image bearing member primarily;

(III) an exposure assembly for forming the electrostatic latent image on the image bearing member having primarily been charged;

(IV) a plurality of developing apparatus each for developing the electrostatic latent image by the use of a non-magnetic toner to form a toner image; and (V) a transfer assembly for sequentially transferring to a transfer medium the toner image formed by each of the developing apparatus;

the developing apparatus comprising;

a toner hopper for holding therein a non-magnetic one-component toner for developing the electrostatic latent image formed on the surface of the image bearing member; and a developing roller for transporting the non-magnetic one-component toner held in the toner hopper, while causing the toner to adhere to the roller surface;

wherein;

the developing roller comprises;

a conductive mandrel;

a charge-providing layer having a charge-providing performance to the toner, formed at the surface of the roller;

a base layer having an elasticity, formed at a position nearer to the mandrel of the roller than the charge-providing layer; and an elastic intermediate layer formed at a position between the base layer and the charge-providing layer; and a composition for forming the elastic intermediate layer has a contact angle to water which is smaller than the contact angle to water of a composition for forming the base layer.

DESCRIPTION OF THE PREFERRED EMBODIMENTS

Figure 1:
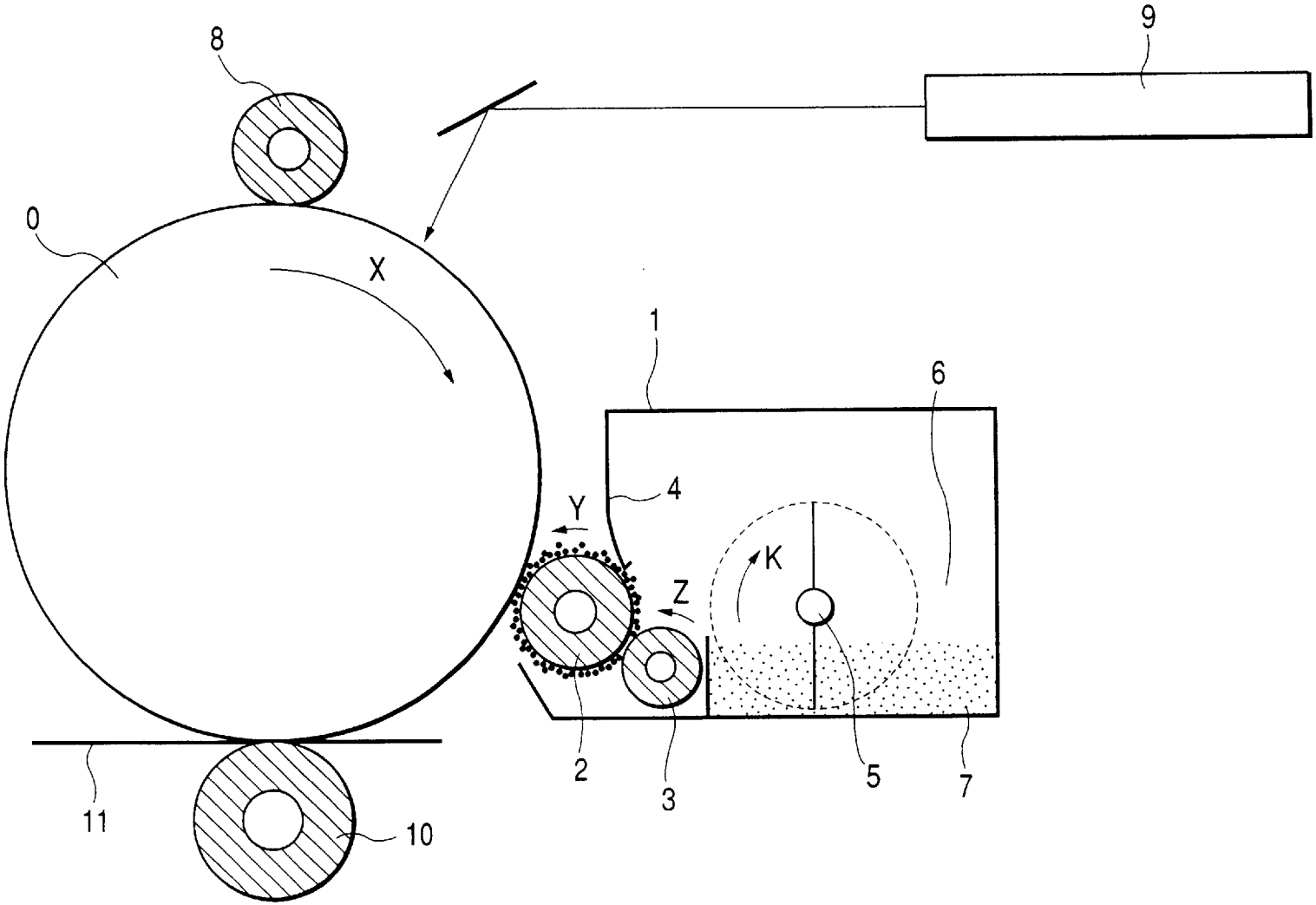
FIG. 1 is a diagrammatic view showing the construction of an electrophotographic image-forming apparatus according to Embodiment 1 of the present invention.

The developing roller for electrophotography of the present invention has a base layer having an elasticity, and hence it has a low hardness on the whole and applies only a low stress to the toner. Moreover, it has a charge-providing layer at the surface, and hence has a high charge-providing performance also to the spherical toner. In addition, it has an elastic intermediate layer formed between the base layer and the charge-providing layer, and a composition for forming the elastic intermediate layer has a contact angle to water which is smaller than the contact angle to water of a composition for forming the base layer, in other words, the elastic intermediate layer has a high surface energy. Hence, the bond strength between the elastic intermediate layer and the charge-providing layer is so high that the local separation of the charge-providing layer may hardly occur. In addition, both the base layer and the elastic intermediate layer have so high an elasticity that, even when any stress is applied to the interface between both the layers, they can deform to absorb the stress and the local separation or peeling of the charge-providing layer may also hardly occur.

The charge-providing layer formed at the surface of the developing roller for electrophotography of the present invention may preferably have a volume resistivity of from $10^4$ Ω·cm to $10^8$ Ω·cm as a value at which the image force acting on the toner can be made appropriate and also any electric current flowing through the photosensitive member surface does not adversely affect the photosensitive member (drum). The developing roller for electrophotography of the present invention applies a voltage to the mandrel at the center to generate at the surface an electric field for development. Accordingly, the elastic intermediate layer may also preferably have substantially the same conductivity as the charge-providing layer. That is, the elastic intermediate layer may preferably have a volume resistivity of from $10^4$ Ω·cm to $10^8$ Ω·cm which is substantially equal to the volume resistivity of the charge-providing layer.

The developing roller for electrophotography of the present invention may preferably have a hardness (Hr) of 50 degrees or below, and more preferably from 20 degrees to 50 degrees , as Asker-C hardness. This can reduce the stress to toner and, even when the toner having a core/shell structure encapsulating a wax having a low melting temperature is used, can make the toner less deteriorate.

In the present invention, the base layer may be made up using a solid rubber composed chiefly of silicone rubber. This is preferable because the low hardness as stated above can be achieved. When the base layer is formed in porous structure, a low hardness on the same level can be achieved using, besides the silicone rubber, materials such as ethylene-propylene-diene copolymer rubber (EPDM), urethane rubber and nitrile-butadiene rubber (NBR).

In the present invention, the base layer may preferably have a hardness (Hb) of from 15 degrees to 50 degrees, and more preferably from 20 degrees to 45 degrees, as Asker-C hardness. If the base layer has a hardness higher than 50 degrees, it may be difficult to make the developing roller on the whole have the hardness of 50 degrees or below while sufficiently ensuring the bond strength between the charge-providing layer and the elastic intermediate layer. If it has a hardness lower than 15 degrees, the oil component in the rubber is in so large a quantity that the oil component having exuded from the interior of the rubber may affect the adhesion to the elastic intermediate layer in a high-temperature condition.

Where the elastic intermediate layer is chiefly composed of any one of EPDM, urethane rubber and NBR, it can have a high surface energy and hence an elastic intermediate layer having a high adhesion and a high elasticity can be formed.

The case where the elastic intermediate layer is not formed in porous structure but made up using a solid rubber having a high elasticity is preferred to the case where it is formed in porous structure, because the elastic intermediate layer and the base layer can have a larger contact area and can be better connected and also the surface shape of the developing roller can be made smooth to improve image quality.

In the present invention, the elastic intermediate layer may preferably have a hardness (Hm) of from 20 degrees to 50 degrees as Asker-C hardness. If the elastic intermediate layer has a hardness higher than 50 degrees, it may be difficult to make the developing roller on the whole have the hardness of 50 degrees or below. If it has a hardness lower than 15 degrees, the adhesion between the charge-providing layer and the elastic intermediate layer tends to lower.

In the present invention, the developing roller hardness (Hr), the base layer hardness (Hb) and the elastic intermediate layer hardness (Hm) may preferably satisfy the following relationship:

$$Hr \geqq Hb,\ Hm \geqq Hb;$$

more preferably satisfy the following relationship:

$$Hr \geqq Hm \geqq Hb;$$

and more preferably satisfy the following relationship:

$$Hr \geqq Hm > Hb.$$

If Hr<Hm, the stress acting between the base layer and the elastic intermediate layer because of the deformation of both the layers may be absorbed with difficulty, and hence the local separation between the base layer and the elastic intermediate layer tends to occur.

If Hm<Hb, the charge-providing layer and the elastic intermediate layer may have a large difference in hardness in an attempt to make the developing roller have a low hardness on the whole, and hence the local separation between the charge-providing layer and the elastic intermediate layer tends to occur.

When Hm>Hb, the charge-providing layer and the elastic intermediate layer can have a small difference in hardness. This is preferable because the bond strength between the charge-providing layer and the elastic intermediate layer is improved.

The charge-providing layer may be bonded to the elastic intermediate layer by using an adhesive. This can make stronger the adhesive force of the charge-providing layer.

The charge-providing layer may chiefly be composed of a resin having charge polarity opposite to the polarity of the charge polarity of the toner, whereby the toner and the charge-providing layer are charged to polarities opposite to each other by the friction between them, and hence an attraction force attributable to Coulomb force is produced between the toner and the charge-providing layer so that the toner can be transported while causing it to adhere well to the surface of the charge-providing layer.

The stress to toner can be reduced more and the spherical toner can be made to deteriorate less by making the surface of the charge-providing layer have a lower coefficient of dynamic friction. Here, since the charge-providing layer has a high charge-providing performance, it can make the spherical toner generate sufficient triboelectricity even when its friction with the toner is made smaller.

The charge-providing layer may chiefly be composed of any one of polyamide resin, acrylic urethane resin, acrylic polyester urethane resin and an acrylic silicone resin, whereby a charge-providing layer can be formed which has the surface having a low coefficient of dynamic friction and has a high charge-providing performance.

In the electrophotographic developing apparatus mounted with the developing roller for electrophotography according to the present invention, the stress to toner is so low as to make the spherical toner less deteriorate, and also the non-magnetic one-component spherical toner can be transported in a well charged state to participate in development.

In the present invention, the developing roller may preferably have a net resistivity of from $1\times10^4$ Ω to $1\times10^8$ Ω, and more preferably from $1\times10^4$ Ω to $1\times10^7$ Ω. If the developing roller has a net resisitivity lower than $1\times10^4$ Ω, electric charges tend to be injected into the image bearing member upon application of development bias at the time of development to tend to cause disorder of electrostatic latent images. If it has a net resisitivity higher than $1\times10^8$ Ω, it may be difficult to form sufficient development potential between the image bearing member and the developing roller even upon application of development bias at the time of development.

In order to control the net resistivity of the developing roller within the above range, the base layer may preferably have a volume resistivity of from $1\times10^4$ Ω·cm to $1\times10^8$ Ω·cm.

For the same reason, the elastic intermediate layer may also preferably have a volume resistivity of from $1\times10^4$ Ω·cm to $1\times10^8$ Ω·cm.

For the same reason, the charge-providing layer may also preferably have a volume resistivity of from $1\times10^4$ Ω·cm to $1\times10^8$ Ω·cm.

In order to control the volume resistivity of the base layer, elastic intermediate layer and charge-providing layer so as to be within the ranges of volume resistivity as specified above, conductive particles may preferably be dispersed in the rubber or resin constituting the respective layers.

In the present invention, the net resistivity of the developing roller and the volume resistivity of the base layer, elastic intermediate layer and charge-providing layer are measured in the following way.

Measurement of Net Resistivity

A load of 500 g is applied to each end of the mandrel of the developing roller (total pressure: 1 kg), and the developing roller is brought into pressure contact with an aluminum drum (30 mm diameter in the present embodiment) having the same diameter as the photosensitive drum used as the image bearing member. The aluminum drum is kept grounded. Then, the aluminum drum and the developing roller are rotated at 100 mm/s and 170 mm/s, respectively, and a voltage of 100 V is applied to the developing roller's conductive mandrel, where the resistance between the developing roller and the aluminum drum is regarded as net resistivity.

Measurement of Volume Resistivity

1. Elastic intermediate layer and charge-providing layer:

Compositions for forming the elastic intermediate layer and the charge-providing layer are separately coated (thickness: 50 μm) on aluminum foil (thickness: 100 μm) to prepare samples. Resistivity of the samples is measured with a resistivity measuring instrument (trade name: High Resta UP, J-BOX; manufactured by Mitsubishi Chemical Co.) under conditions of a measurement voltage of 100 V.

2. Base layer:

A sample sheet of 50 mm long, 50 mm wide and 2 mm thick is prepared which is formed using a composition for forming the base layer. Resistivity of this sample is measured with a resistivity measuring instrument (trade name: High Resta UP, J-BOX; manufactured by Mitsubishi Chemical Co.) under conditions of a measurement voltage of 100 V.

In the present invention, the spherical toner is meant to be a truly spherical or substantially spherical toner having a shape factor SF-1 of from 100 to 160 and a shape factor SF-2 of from 100 to 140. It may preferably have a shape factor SF-1 of from 100 to 140 and a shape factor SF-2 of from 100 to 120.

In the present invention, the SF-1 and SF-2 indicating the degree of sphericity of a particle are values obtained by sampling at random 100 particles of toner images by the use of FE-SEM (S-800; a scanning electron microscope manufactured by Hitachi Ltd.), introducing their image information in an image analyzer (LUZEX-3; manufactured by Nireko Co.) through an interface to make analysis, and calculating the data according to the following equations. The values obtained are defined as shape factors SF-1 and SF-2, respectively.

$$\text{SF-1}=(\text{MXLNG})^2/\text{AREA}\times\pi/4\times100$$

$$\text{SF-2}=(\text{PERI})^2/\text{AREA}\times1/4\pi\times100$$

wherein AREA represents a projected area of a toner particle; MXLNG represents an absolute maximum length of diameter of the toner particle; and PERI represents a peripheral length of the toner particle.

The shape factor SF-1 defined by the above equation indicates the degree of sphericity, where 100 represents a perfect sphere, and spherical particles becomes gradually shapeless with an increase in the numerical value. As for the SF-2, it indicates the degree of unevenness of the particle, where 100 represents an unevenness-free perfect sphere, and the unevenness of toner particle surfaces becomes conspicuous with a decrease in the numerical value.

The non-magnetic one-component toner used in the present invention may be a spherical toner having the above shape factors and a toner having a core/shell structure in which the core is chiefly composed of a low-melting wax, the low-melting wax has a melting point of preferably from 40 to 90° C. and this core formed of the low-melting wax is covered with a shell formed of a resin. This is preferable because the toner can be transferred with a high efficiency and can be fixed at a low temperature.

The non-magnetic one-component toner may be a polymerization toner obtained by subjecting a polymerizable monomer composition having at least a polymerizable monomer and a colorant, to suspension polymerization in an aqueous medium.

Such a low-melting spherical toner having a good transfer efficiency and advantageous for energy saving can be obtained in the manner as described below.

The spherical toner as described above are readily obtainable by forming part or the whole of the non-magnetic one-component toner by polymerization. More specifically, when the toner is formed by polymerization, materials are made present in a dispersion medium in the form of pre-toner (monomer composition) particles, and the necessary part is formed by polymerization reaction. Hence, the toner particles formed are spherical and have surfaces made fairly smooth.

In order to make the toner have a low melting point so that easy production of the spherical toner and energy saving can simultaneously be achieved, the spherical toner may preferably be provided with the core/shell structure and only the shell is formed by polymerization. Needless to say, the core/shell structure has the function to impart anti-blocking properties without damaging a good fixing performance of the toner. Also, compared with a polymerization toner as a bulk having no cores, the method of polymerizing only the shell enables easy removal of residual monomer in the step of post-treatment carried out after the step of polymerization. Thus, such structure is preferred.

As a chief component of the core of the spherical toner having such a core-shell structure, it is preferable to use a low-softening substance. In particular, it is preferable to use a compound having a main maximum peak value of from 40 to 90° C. as melting points measured by a method according to ASTM D3418-8. If the main maximum peak value is lower than 40° C., the low-softening substance may have a weak self-cohesive force, undesirably resulting in weak high-temperature anti-offset properties. If on the other hand the main maximum peak value is higher than 90° C., the fixing temperature may become undesirably higher. In the case when the toner particles are obtained directly by the polymerization method, since the granulation and the polymerization are carried in an aqueous system, the low-softening substance may undesirably precipitate mainly during the granulation if the main maximum peak is high, so that the suspension system may be hindered.

The main maximum peak value measured by the method according to ASTM D3418-8 is measured with, e.g., DSC-7, manufactured by Perkin Elmer Co. Here, the temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of temperature rise of 10° C./min.

The low-softening substance usable when the spherical toner used in the present invention is produced may specifically include, e.g., paraffin waxes, polyolefin waxes, Fischer-Tropsch waxes, amide waxes, higher fatty acids, ester waxes, and derivatives of these or grafted or blocked compounds of these. Also, such a low-softening substance may preferably be added in the toner in an amount of from about 5 to 30% by weight. Its addition in an amount less than 5% by weight may cause a difficulty in the removal of the residual monomers as stated above. On the other hand, its addition in an amount more than 30% by weight tends to cause toner particles to coalesce one another during granulation also in the production by polymerization, tending to produce toner particles having a broad particle size distribution, which are not suited for use in the present invention.

As external additives usable in the present invention, it is preferable to use those having a particle diameter not larger than 1/10 of a weight-average particle diameter of the toner particles, in view of its durability when added to the toner. The particle diameter of this external additive refers to an average particle diameter obtained by observing the surfaces of toner particles on an electron microscope. Such external additives may include, e.g., fine powders of metal oxides such as aluminum oxide, titanium oxide, strontium titanate, cerium oxide, magnesium oxide, chromium oxide, tin oxide and zinc oxide; nitrides such as silicon nitride; carbides such as silicon carbide; metal salts such as calcium sulfate, barium sulfate and calcium carbonate; fatty acid metal salts such as zinc stearate and calcium stearate; carbon black; and silica. Any of these external additives may be used in an amount of from 0.01 to 10 parts by weight, and preferably from 0.05 to 5 parts by weight, based on 100 parts by weight of the toner particles. These external additives may be used alone or may be used in combination of two or more types. As these external additives, it is more preferable to use those having been subjected to hydrophobic treatment.

Embodiments of the developing roller in the present invention and the developing apparatus making use of the developing roller will be described below in detail with reference to the accompanying drawings.

Embodiment 1

FIG. 1 shows an image-forming apparatus making use of a developing apparatus according to Embodiment 1 of the present invention.

As shown in FIG. 1, around, e.g., a photosensitive drum 0 as an image bearing member that can hold thereon an electrostatic latent image, provided are a charging roller 8 as a charging assembly for charging the surface of the photosensitive drum 0 uniformly, an exposure means 9 for exposing the periphery of the photosensitive drum 0 to light in accordance with image information to form an electrostatic latent image, a developing apparatus 1 for developing the electrostatic latent image by causing a non-magnetic one-component toner (hereinafter often simply "toner") 7 to adhere onto the latent image, and a transfer roller 10 as a transfer assembly for transferring the developed toner image to a transfer medium 11.

In the present embodiment, a negatively chargeable OPC photosensitive member of 30 mm in outer diameter is used as the photosensitive drum 0, and a laser optical system is used as the exposure means 9. As the transfer method, a roller transfer method is used. The transfer roller 10 is a semiconducting roller having an outer diameter of 16 mm and a volume resistivity of about $10^9$ Ω·cm.

The developing apparatus 1 has a toner hopper 6 which holds the toner 7 therein, an agitating means 5 by which the toner 7 held in the toner hopper 6 is transported and fed to the vicinity of a toner feed roller 3 while agitating the toner with rotation, a toner feed roller 3 for feeding the toner 7 in a stated quantity to a developing roller 2, a developing roller 2 for causing the toner 7 to adhere to the electrostatic latent image on the photosensitive drum 0 to develop the latent image as a toner image, and a developing blade 4 for keeping the toner on the developing roller 2 surface to the stated quantity and also regulating the charge quantity of the toner 7.

The toner feed roller 3 is constituted of a foamed material having a hardness of about 10 degrees as measured with Asker-CsC2 Hardness Meter (trade name; manufactured by Kohbunshi Keiki K.K.). In the present embodiment, as an example, a urethane spongy roller having an outer diameter of 16 mm and a hardness of about 10 degrees as measured with Asker-CsC2 Hardness Meter is used as the toner feed roller 3. As materials for the toner feed roller 3, besides the urethane used in the the present embodiment, silicone may also be used. Also, the form of foaming may be either of open-cell foaming and closed-cell foaming. In order to prevent the toner from entering the roller surface pores to cause deterioration, the closed-cell foaming may preferably be used. Also, used as the developing blade 4 is what is called an L-shaped metal blade, in which as shown in FIG. 1 the leading edge region coming into touch with the developing roller 2 is bent into L-shape. As materials therefor, phosphor bronze and stainless steel may be used. In the present embodiment, a stainless steel thin sheet of 100 μm thick is used.

An image-forming method using this image-forming apparatus will be described below.

The photosensitive drum 0 is rotatingly driven in the clockwise direction as viewed in FIG. 1 (the direction of an arrow X in the drawing) at a peripheral speed Vx, and is uniformly charged when its surface reaches the charging roller 8. The surface charged uniformly is exposed to light by the exposure means 9 in accordance with image information, and an electrostatic latent image corresponding to the image information is formed. The electrostatic latent image reaches the developing apparatus 1, whereupon the toner is caused to adhere onto the electrostatic latent image, and the latent image is developed as a toner image. The toner image reaches the transfer roller 10, whereupon it is transferred to the transfer medium 11. The toner image thus transferred is permanently fixed onto the transfer medium 11 by a fixing means (not shown). In the present embodiment, the surface of the photosensitive drum 0 is uniformly charged to a charge potential Vd of −700 V, which is then exposed by the exposure means 9 to provide a latent image potential V1 of −100 V.

Development by the developing apparatus 1 is performed in the manner as described below.

The agitating means 5 feeds the toner 7 to the toner feed roller 3 while agitating the toner with its rotation in the clockwise direction as viewed in FIG. 1 (the direction of an arrow K in the drawing). The toner feed roller 3 is rotated in the counter-clockwise direction as viewed in FIG. 1 (the direction of an arrow Z in the drawing), and guides the toner 7 to the contact nip zone between the toner feed roller 3 and the developing roller 2. The toner 7 is charged at this part by its friction with the developing roller 2, and is carried on the surface of the developing roller 2. The toner 7 carried on the surface of the developing roller 2 is transported by the rotation of the developing roller 2 in the counter-clockwise direction as viewed in FIG. 1 (the direction of an arrow Y in the drawing), and reaches the part where the developing blade 4 comes into touch with the developing roller 2, whereupon its quantity of adhesion and charge quantity are regulated. To the developing roller 2, a development bias voltage of $-350\ V_{DC}$ is kept applied. The toner 7 reaches the region where the photosensitive drum 0 and the developing roller 2 come into contact, whereupon the toner 7 is caused to adhere to the photosensitive drum 0 by the aid of the development bias voltage, so that the electrostatic latent image is developed.

Here, the quantity of the toner 7 fed from the toner feed roller 3 to the developing roller 2 is controlled by controlling the peripheral-speed ratio of peripheral speed Vz of the toner feed roller 3 to peripheral speed Vy of the developing roller 2. The quantity of the toner 7 fed from the developing roller 2 to the photosensitive drum 0 is controlled by controlling the peripheral-speed ratio of peripheral peripheral speed Vy of the developing roller 2 to peripheral speed Vx of the photosensitive drum 0.

The peripheral speed Vx of the photosensitive drum 0 determines transfer speed, and is called "process speed". In the present embodiment, the values of peripheral speed are so set that Vy is 1.7 and Vz is 0.6 when Vx is 1. More specifically, in the present embodiment, set values are process speed Vx=100 mm/sec, Vy=170 mm/sec and Vz=60 mm/sec. This process speed corresponds to an output speed of about 17 sheets of A4-size paper per minute [17 ppm (paper per minute)]. The ratios of peripheral speed and values of peripheral speed are by no means limited to these.

The construction of the developing roller 2 which is characteristic of the present invention will be described below with reference to FIG. 2. In the present embodiment, the developing roller 2 comprises a conductive mandrel 2*a* having an outer diameter of 8 mm, a base layer 2*b* formed thereon, an elastic intermediate layer 2*c* further formed thereon and a charge-providing layer 2*e* formed on its surface via an adhesive 2*d*, and has an outer diameter of 16 mm. The conductive mandrel 2*a* is made of a conductive metal such as aluminum or stainless steel. The base layer 2*b* is comprised of a solid layer having a low-hardness LTV silicone rubber (low-temperature vulcanized silicone rubber). In the present embodiment, it is formed in a thickness of 3.94 mm and an Asker-C hardness of 40 degrees. The charge-providing layer 2*e* may be formed in a thickness of from 1 to 100 μm, using polyamide resin, acrylic modified urethane resin, acrylic polyester urethane resin or acrylic modified silicone resin, having a low coefficient of dynamic friction and a high charge-providing performance. In the present embodiment, a charge-providing layer 2*e* having polyamide resin is formed in a thickness of 30 μm.

Rubber materials such as NBR, EPDM and urethane rubber have a higher hardness than the LTV silicone rubber. Hence, a developing roller 2 in which the charge-providing layer 2*e* is formed on a single layer of the former rubber material cannot be made to have a sufficiently low hardness. However, the use of LTV silicone rubber in the base layer 2*b* can make the developing roller 2 a low-hardness roller that may apply only a low stress to the toner 7. From the viewpoint of making the spherical toner 7 deteriorate less, the developing roller 2 may preferably have a hardness of 45 degrees or below as Asker-C hardness. In the present embodiment, it is set at 40 degrees.

The elastic intermediate layer 2*c* which is characteristic of the present invention is constructed as described below. As the elastic intermediate layer 2*c*, a rubber-material solid layer of from 1 to 100 μm thick is formed. As rubber materials used in the elastic intermediate layer 2*c*, rubbers having a high surface energy, such as EPDM, urethane rubber and NBR are used. These rubbers may also be blended with a resin. In the present embodiment, an NBR elastic intermediate layer 2*c* having a thickness of 30 μm and an Asker-C hardness of 45 degrees is used.

The charge-providing layer 2*e* is formed on the surface of the elastic intermediate layer 2*c* having such a rubber material having a high surface energy and many active groups, such as NBR, EPDM or urethane rubber, whereby the charge-providing layer 2*e* can be more firmly bonded and formed than when it is formed on a silicone rubber having a low surface energy as done in the prior art. In the present invention, a contact angle to water is used as an index of the surface energy of compositions for forming the respective layers. As a measuring method, rubber materials of various types are each formed on a flat plate having a thickness of 3 to 5 mm, and their contact angles to water are measured with a contact angle meter (Model CA-X) manufactured by Kyowa Kaimen Kagaku K.K. The silicone rubber, having a low surface energy, has a large contact angle to water. The NBR or the like, having a high surface energy, has a small contact angle to water. The silicone rubber has a contact angle to water to 90 degrees, and the NBR a contact angle to water of 70 degrees. Also, since the base layer 2*b* and the elastic intermediate layer 2*c* both have an elasticity, the adhesion between both layers is higher than the adhesion between the silicon rubber and the resin having a low elasticity. More specifically, the stress acting at the adhesive interface between the base layer 2*b* and the elastic intermediate layer 2*c* is absorbed by the deformation of both the layers to become small, and hence separation may hardly occur between both the layers. Thus, in the present invention, the separation or peeling of the charge-providing layer 2*e* can be made to occur less, and also the separation of the elastic intermediate layer 2*c* can be made to occur less.

Here, since the elastic intermediate layer 2*c* has the above thickness of from 1 to 100 μm, the elastic intermediate layer 2*c* must be made to have conductivity in order to provide a conductivity across the developing roller 2 surface and the mandrel 2*a*. Accordingly, the elastic intermediate layer 2*c* is made to have conductivity by dispersing therein conductive particles such as metal oxide or carbon particles in an appropriate quantity. The charge-providing layer 2*e* may preferably be made to have a volume resistivity of from $1\times10^4\ \Omega\cdot cm$ to $1\times10^8\ \Omega\cdot cm$ as described previously. The elastic intermediate layer 2*c* may also preferably be made to have substantially the same volume resistivity in order to make it have substantially the same conductivity. In the present embodiment, the volume resistivity of the base layer 2*b*, the elastic intermediate layer 2*c* and the charge-providing layer 2*e* is controlled to about $1\times10^5\ \Omega\cdot cm$. As the result, the developing roller 2 has a net resistivity of about $10^5\ \Omega$ to $10^6\ \Omega$.

Figure 2:
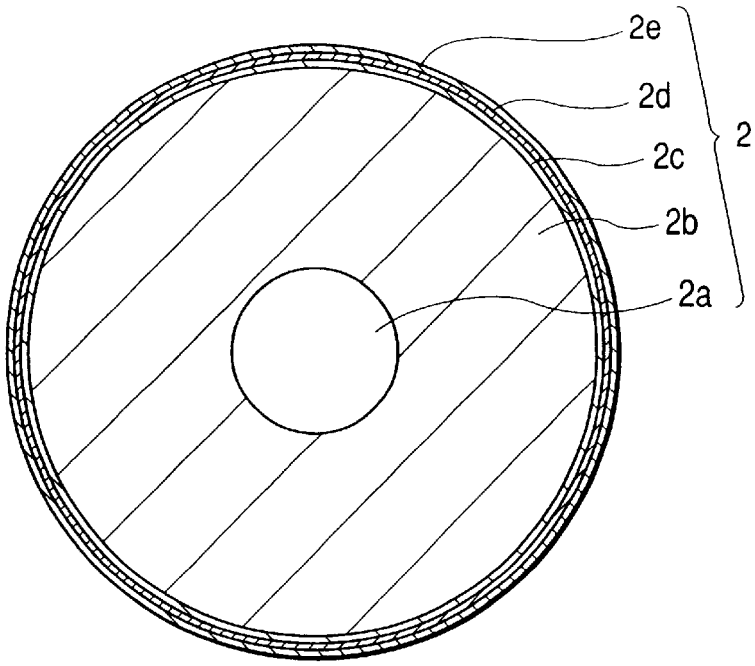
FIG. 2 is a diagrammatic view showing the construction of a developing roller for electrophotography according to Embodiment 1 of the present invention.

The developing roller shown in FIG. 2 was set in the developing apparatus shown in FIG. 1, and an image reproduction running test was made. As a result, any separation of the charge-providing layer 2*e* and elastic intermediate layer 2*c* did not occur even in 50,000-sheet running.

As described above, what is characteristic of the present embodiment is that the developing roller 2 applicable to the developing apparatus for non-magnetic one-component toner is formed in a multi-layer construction consisting of the base layer 2*b* having a low hardness, the charge-providing layer 2*e* having a high charge-providing performance and the elastic intermediate layer 2*c* having a rubber-elasticity which may hardly cause stress at its interface with the base layer 2*b* because of a high elasticity and have a good adhesion to the charge-providing layer 2*e* because of a high surface energy, and is so made up that its elastic intermediate layer 2*c* and charge-providing layer 2*e* have substantially the same volume resistivity of from $1\times10^4$ Ω·cm to $1\times10^8$ Ω·cm.

More specifically, in the developing roller of the present invention, the base layer 2*b* is formed on the surface of the conductive mandrel 2*a*, the elastic intermediate layer 2*c* having a high elasticity and a good adhesion is formed on the surface of the base layer 2*b* and the charge-providing layer 2*e* is formed on the surface of the elastic intermediate layer 2*c*. Thus, it becomes possible to obtain a low-hardness developing roller 2 which may hardly cause the separation of the charge-providing layer 2*e* and also has a low coefficient of dynamic friction and a high charge-providing performance, and to obtain a developing apparatus making use of such a developing roller.

As the non-magnetic one-component toner used in the present embodiment, a non-magnetic one-component toner is used which is comprised of substantially spherical toner particles having a core/shell structure in which a core wax is encapsulated with a shell styrene-acrylic copolymer and having a weight-average particle diameter of 7 μm and shape factors Sf-1 of 120 and SF-2 of 110, and a hydrophobic inorganic fine powder externally added to such particles which is comprised of the external additive described previously.

Incidentally, the present embodiment is described by giving an example of a contact development system in which the developing roller 2 is disposed in contact with the photosensitive drum 0. The same effect is obtainable also in a non-contact development system in which the developing roller 2 is disposed in non-contact with the photosensitive drum 0. More specifically, although in the non-contact development system there is a possibility of local separation of the charge-providing layer 2*e* of the developing roller 2 because of the stress applied from the developing blade 4 and toner feed roller 3, the use of the developing roller 2 described in the present embodiment enables prevention of such separation from occurring.

Embodiment 2

Figure 3:
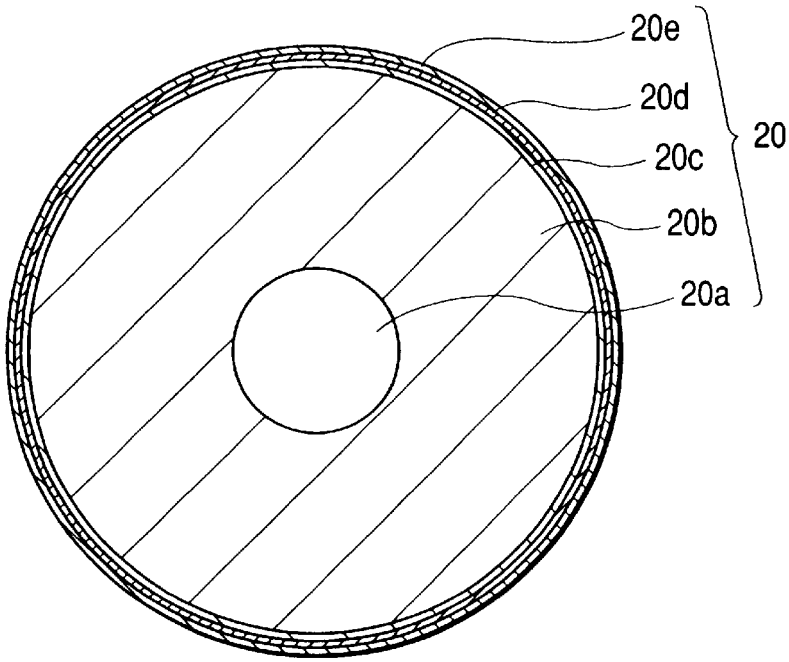
FIG. 3 is a diagrammatic view showing the construction of a developing roller for electrophotography according to Embodiment 2 of the present invention.
Figure 4:
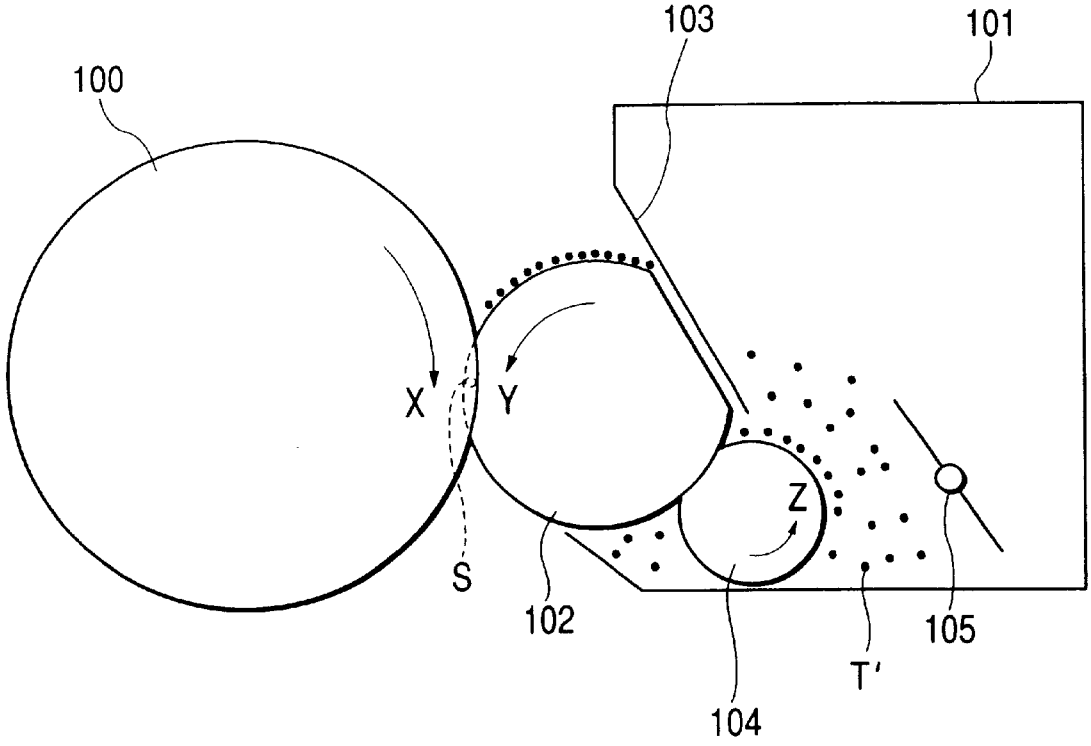
FIG. 4 is a diagrammatic view showing the construction of a conventional electrophotographic developing apparatus.
Figure 5:
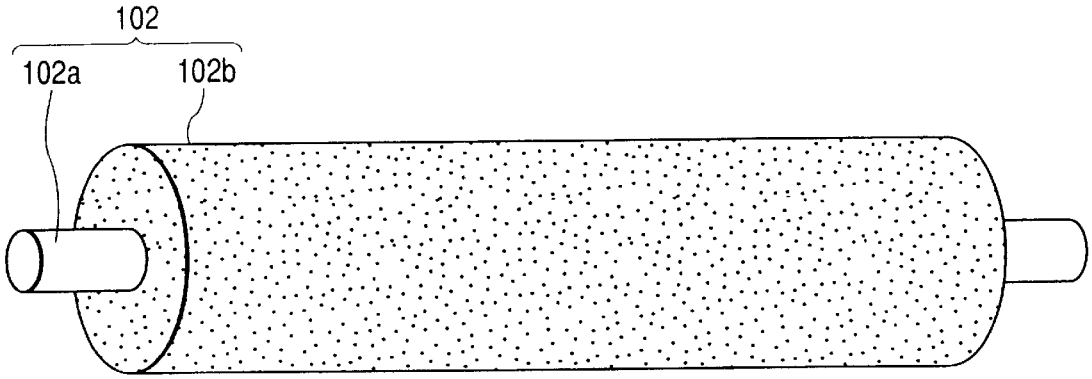
FIG. 5 is a diagrammatic view showing the construction of a conventional developing roller for electrophotography.
Figure 6:
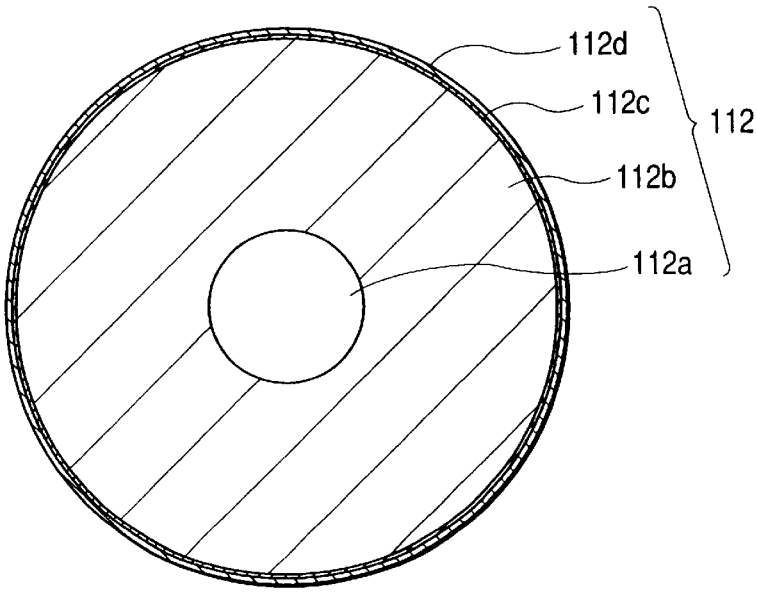
FIG. 6 is a diagrammatic view showing the construction of a conventional developing roller for electrophotography on the surface of which a charge-providing layer has been formed.

FIG. 3 diagrammatically illustrates a developing roller according to Embodiment 2 of the present invention. What has been described in Embodiment 1 is an instance where the base layer 2*b* is comprised of a solid rubber. A developing roller 20 of Embodiment 2 is the same as that of Embodiment 1 except that its base layer 20*b* is formed in a porous structure.

For the base layer 20*b*, the material that is a solid type conductive rubber and has a sufficiently low hardness is substantially only the LTV silicon rubber shown in Embodiment 1. In the case when the solid type conductive rubber is formed using EPDM, urethane rubber or the like, it is difficult to attain substantially the same low hardness as that of the base layer 2*b* shown in Embodiment 1. On the other hand, where the base layer 20*b* is formed in a porous structure, materials can be selected from a wider range. More specifically, a conductive rubber having a porous structure may be formed using a material such as EPDM, urethane rubber or NBR, whereby the hardness can be made sufficiently low.

If, however, the base layer 20*b* is formed of a sponge rubber and a charge-providing layer 20*e* is formed thereon, both the layers have a small contact area, and hence the charge-providing layer 20*e* has a poor adhesion. Also, since the charge-providing layer 20*e* is a thin layer of about 1 to 100 μm as stated previously, the surface unevenness of the sponge layer may come out to the developing roller 20 surface, resulting in a large surface roughness Rmax of the developing roller 20 surface. According to studies made by the present inventors, it is preferable for the surface of the developing roller 20 to have Rmax of about 15 μm or smaller, and roughness with a numerical value larger than this may cause an influence of sponge-layer surface shape on reproduced images to tend to result in uneven and very coarse images. Incidentally, the surface roughness Rmax refers to that defined in JIS B0601, and is measured with a surface roughness analyzer SE-30H (trade name; manufactured by Kosaka Kenkyusho K.K.)

To prevent such problems, it is preferable to form on the surface of the base layer 20*b* having sponge rubber an elastic intermediate layer 20*c* preferably having a thickness of about 0.5 to 1 mm and comprised of a solid rubber. Even when such an elastic intermediate layer 20*c* is provided, the whole developing roller 20 can be made to have a sufficiently low hardness as long as the layer is provided in the thickness of about 0.5 to 1 mm and the base layer 20*b* in a sufficiently low hardness of 15 to 45 degrees as Asker-C hardness.

As a material for this elastic intermediate layer 20*c*, like Embodiment 1, EPDM, urethane rubber or NBR is used, which promises a good adhesion to the charge-providing layer 20*e*. The charge-providing layer 20*e* is, like Embodiment 1, required to have a high charge-providing performance to the toner 7 and have a small rubbing force at its surface coming in contact with the photosensitive drum 0, i.e., a low coefficient of dynamic friction at its surface, and is formed using a resin such as polyamide resin, acrylic urethane resin, acrylic polyester urethane resin or acrylic modified silicone resin. Here, in order to control the surface roughness of the developing roller 20, releasing particles such as fluorine resin particles or polyamide resin particles may be dispersed in the charge-providing layer 20*e*. The same applies also to Embodiment 1.

A detailed example of the construction of the developing roller 20 shown in FIG. 3 is shown below. The developing roller 20 has an outer diameter of about 16 mm. On a conductive mandrel 20*a* having an outer diameter of 6 mm, a base layer 20*b* having an Asker-C hardness of 40 degrees, having an EPDM sponge rubber obtained by blowing an EPDM rubber material containing conductive particles and having a contact angle to water of 80 degrees, is formed in a thickness of 4.5 mm. Then, on this layer, an elastic intermediate layer 20*c* having an Asker-C hardness of 45 degrees, is formed in a thickness of 500 μm. On the surface of the elastic intermediate layer 20*c*, an adhesive 20*d* is provided in a thickness of 1 μm or smaller, and a charge-providing layer 20*e* comprised of acrylic urethane resin containing conductive particles is formed thereon in a thickness of about 10 μm. The charge-providing layer 20*e* may preferably have a volume resistivity of approximately from $1\times10^4$ Ω·cm to $1\times10^8$ Ω·cm as described previously. In the present embodiment, it is set at $1\times10^5$ Ω·cm. Like Embodiment 1, the volume resistivity of other each layer is set at about $1\times10^5$ Ω·cm, which is substantially the same as that of the charge-providing layer 20*e*.

Incidentally, the contact angle to water of the EPDM rubber material for forming the EPDM sponge rubber base layer 20*b* can not be measured in the foamed state, and hence it is measured on EPDM rubber material formed on a flat plate in an unfoamed state.

In the present embodiment, the chief material of the base layer 20*b* is the EPDM sponge rubber obtained by blowing the EPDM rubber material having a contact angle to water of 80 degrees, and the chief material of the elastic intermediate layer 20*c* is the NBR solid rubber having a contact angle to water of 70 degrees. Thus, the composition for forming the elastic intermediate layer has a contact angle to water which is smaller than the contact angle to water of the composition for forming the base layer. Hence, both can well be joined because the adhesion between the elastic intermediate layer and the charge-providing layer is firm and also both the base layer and the elastic intermediate layer have an elasticity.

The developing roller 20 described above was set in the developing apparatus 1 shown in FIG. 1, and an image reproduction running test was made in the same manner as in Embodiment 1. As a result, any separation of the charge-providing layer 20*e* and elastic intermediate layer 20*c* did not occur even in 50,000-sheet running.

Embodiment 3

In Embodiment 3 of the present invention, the developing apparatus 1 shown in FIG. 1 is made up as an apparatus unit detachably mountable to the main body of an image-forming apparatus (e.g., a copying machine, a laser beam printer or a facsimile machine).

In the apparatus unit in Embodiment 3 of the present invention, the developing apparatus 1 as the apparatus unit is mounted to the body of the image-forming apparatus by means of, e.g., pins or bolts. Where the non-magnetic one-component toner held in the toner hopper 6 inside the developing apparatus 1 has become less than the prescribed quantity as a result of repeated use, the pins or bolts may be removed to detach the developing apparatus 1, and a new developing apparatus may be mounted again by means of pins or bolts.

In the apparatus unit according to Embodiment 3 of the present invention, only the developing apparatus is made up as an apparatus unit. However, in place of the developing apparatus, e.g., the photosensitive drum 0 as the image bearing member and the charging roller 8 as the charging assembly may be set as one unit to make up an apparatus unit.

Embodiment 4

An image-forming apparatus according to a fourth embodiment of the present invention comprises;

(I) a plurality of image-forming units each having;
- an image bearing member for holding thereon an electrostatic latent image;
- a charging assembly for charging the image bearing member primarily;
- an exposure assembly for forming the electrostatic latent image on the image bearing member having primarily been charged; and
- a developing apparatus for developing the electrostatic latent image by the use of a non-magnetic toner to form a toner image; and (II) a transfer assembly for sequentially transferring to a transfer medium the toner images formed in the plurality of the image-forming units.

This developing apparatus comprises (i) a toner hopper for holding therein a non-magnetic one-component toner for developing the electrostatic latent image formed on the surface of the image bearing member, and (ii) a developing roller for transporting the non-magnetic one-component toner held in the toner hopper, while causing the toner to adhere to the roller surface. As this developing roller, the developing roller of the present invention as described above is used.

An image-forming apparatus which can carry out an image forming method will be described with reference to FIG. 7, in which toner images of different colors are respectively formed in a plurality of image forming units and they are transferred to the same transfer medium while superimposing them sequentially.

In this apparatus, first, second, third and fourth image-forming units 128*a*, 128*b*, 128*c* and 128*d* are arranged, and the image-forming units have latent image bearing members used exclusively therein, i.e., photosensitive drums 119*a*, 119*b*, 119*c* and 119*d*, respectively.

The photosensitive drums 119*a* to 119*d* are provided around their peripheries with exposure means 123*a*, 123*b*, 123*c* and 123*d* as latent-image-forming means, developing apparatus 117*a*, 117*b*, 117*c* and 117*d*, transfer discharging assemblies 124*a*, 124*b*, 124*c* and 124*d*, and cleaning assemblies 118*a*, 118*b*, 118*c* and 118*d*, respectively.

Under such construction, first, on the photosensitive drum 119*a* of the first image-forming unit 128*a*, for example a yellow component color electrostatic latent image is formed by the electrostatic latent image forming means 123*a*. This electrostatic latent image is converted into a visible image (toner image) by the use of a one-component developer having a non-magnetic yellow toner, of the developing apparatus 117*a*, and the toner image is transferred to a recording medium P, a transfer medium, by means of the transfer assembly 124*a*.

In the course the yellow toner image is transferred to the recording medium P as described above, in the second image-forming unit 128*b* a magenta component color electrostatic latent image is formed on the photosensitive drum 119*b*, and is subsequently converted into a visible image (a toner image) by the use of a one-component developer having a non-magnetic magenta toner, of the developing apparatus 117*b*. This visible image (magenta toner image) is transferred superimposingly to a preset position of the recording medium P when the recording medium P on which the transfer in the first image-forming unit 128*a* has been completed is transported to the transfer assembly 124*d*.

Subsequently, in the same manner as described above, cyan and black color toner images are formed in the third and fourth image-forming units 128*c* and 128*d*, respectively, and the cyan and black color toner images are transferred superimposingly to the same recording medium P. Upon completion of such an image-forming process, the recording medium P is transported to a fixing section 122, where the toner images on the recording medium P are fixed. Thus, a multi-color image or full-color image is obtained on the recording medium P. The respective photosensitive drums 119*a*, 119*b*, 119*c* and 119*d* on which the transfer has been completed are cleaned by the cleaning assemblies 118*a*, 118*b*, 118*c* and 118*d*, respectively, to remove the remaining toner, and are served on the next latent image formation subsequently carried out.

In the above image-forming apparatus, a transport belt 125 is used to transport the transfer medium, the recording medium P. As viewed in FIG. 7, the recording medium P is transported from the right side to the left side, and, in the course of this transport, passes through the respective transfer assemblies 124*a*, 124*b*, 124*c* and 124*d* of the image-forming units 128*a*, 128*b*, 128*c* and 128*d*, respectively.

In this image-forming method, as a transport means for transporting the recording medium, a transport belt comprised of a mesh made of Tetoron fiber and a transport belt comprised of a thin dielectric sheet made of a polyethylene terephthalate resin, a polyimide resin or a urethane resin are used from the viewpoint of readiness in working and durability.

After the recording medium P has passed through the fourth image-forming unit 128*d*, an AC voltage is applied to a charge eliminator 120, whereupon the recording medium P is destaticized, separated from the belt 125, thereafter sent into a fixing assembly 122 where the toner images are fixed, and finally sent out through a paper outlet 126.

In the fourth embodiment of the present invention, the image-forming units may preferably be arranged as shown above in FIG. 7. The image-forming units may be of either of vertical arrangement and horizontal arrangement as long as they are arranged in a row.

Figure 7:
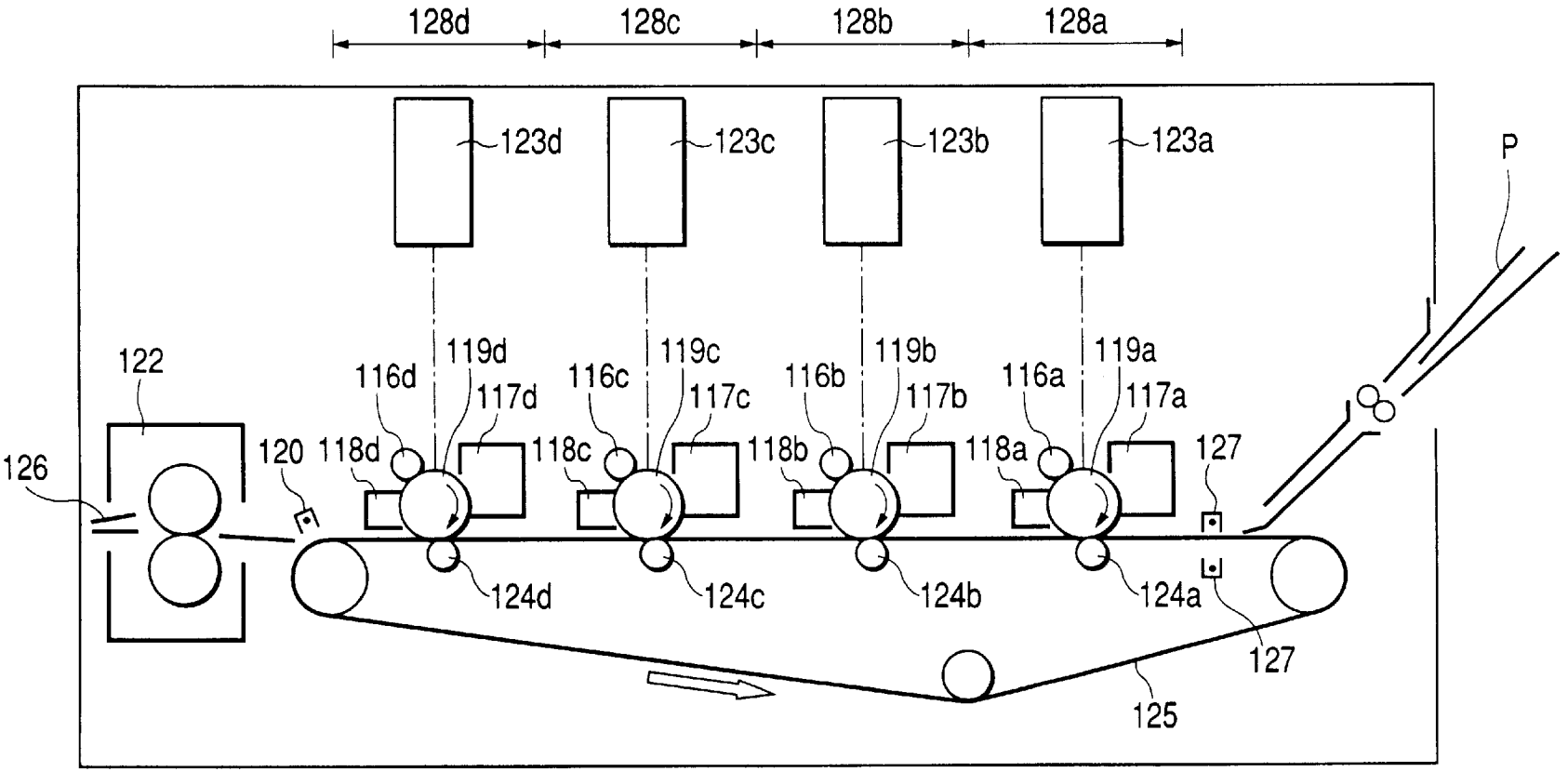
FIG. 7 illustrates an example of an image-forming apparatus according to Embodiment 4 of the present invention.

In the fourth embodiment of the present invention, it is preferred in the construction shown in FIG. 7 that the transfer medium is a recording medium and the toner images are directly transferred from the latent image bearing member to the recording medium and fixed thereto. This is because the construction of the image-forming apparatus according to the fourth embodiment of the present invention enables a high image quality to be kept without dependence on the condition of transfer mediums (recording mediums) and toners.

In addition, the construction of the image-forming apparatus according to the fourth embodiment of the present invention enables the toners to be properly charged over many-sheet running, and hence prevents the toners from scattering to make them not mix into other image-forming units, so that the high image quality can be maintained. Thus, it is suited for multi-color image formation.

Using as a full-color image-forming apparatus having the above four image-forming units a remodeled machine of a full-color copying machine CLC-1000 (trade name; manufactured by CANON INC.) whose respective developing apparatus were so remodeled that the developing apparatus of the non-magnetic one-component contact development system shown in FIG. 1 in the above Embodiment 1 was usable, a running test was made in which full-color images were continuously formed on 5,000 sheets. As the result, it was able to form good high-quality full-color images even in high-temperature and high-humidity environment and low-temperature and low-humidity environment, without causing any separation in the developing roller.

The non-magnetic one-component yellow, cyan, magenta and black toners used in the respective developing apparatus were those comprised of the same substantially spherical toner particles as those used in Embodiment 1 except that only the colorant was changed to obtain the corresponding yellow, cyan, magenta and black toners, to each of which the hydrophobic inorganic fine power was externally added.

Embodiment 5

An image-forming apparatus according to a fifth embodiment of the present invention comprises;

(I) an image bearing member for holding thereon an electrostatic latent image;

(II) a charging assembly for charging the image bearing member primarily;

(III) an exposure assembly for forming the electrostatic latent image on the image bearing member having primarily been charged;

(IV) a plurality of developing apparatus each for developing the electrostatic latent image by the use of a non-magnetic toner to form a toner image;

(V) an intermediate transfer member for sequentially transferring thereto the toner image formed by each of the developing apparatus; and (VI) a transfer assembly for transferring to a transfer medium at one time a multiple toner image transferred to the intermediate transfer member.

This developing apparatus comprises (i) a toner hopper for holding therein a non-magnetic one-component toner for developing the electrostatic latent image formed on the surface of the image bearing member, and (ii) a developing roller for transporting the non-magnetic one-component toner held in the toner hopper, while causing the toner to adhere to the roller surface. As this developing roller, the developing roller of the present invention as described above is used.

An image-forming apparatus according to the fifth embodiment of the present invention which employs the intermediate transfer member will be described below.

Figure 8:
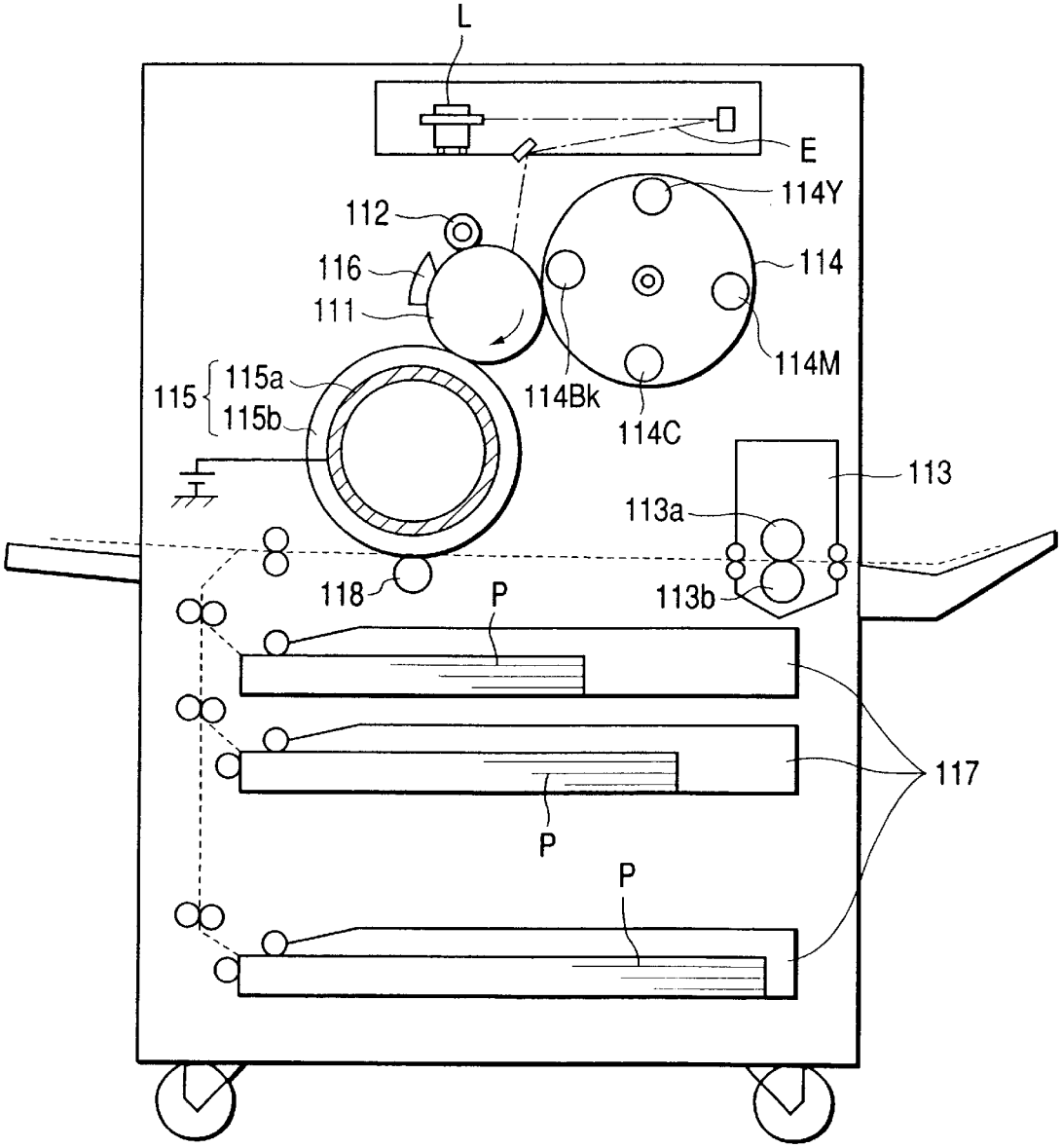
FIG. 8 illustrates an example of an image-forming apparatus according to Embodiment 5 of the present invention.

FIG. 8 schematically illustrates an image-forming apparatus of the present invention in which a multiple toner image is one-time transferred to a recording medium by the use of an intermediate transfer drum as the intermediate transfer member.

A rotatable charging roller 112 as a charging member, to which a charging bias voltage is kept applied, is brought into contact with the surface of a photosensitive drum 111 as a latent image bearing member while rotating the charging roller 112, to effect uniform primary charging of the photosensitive drum surface. Then, a first electrostatic latent image is formed on the photosensitive drum 111 by its exposure to laser light E emitted from a light-source assembly L as an exposure means. The first electrostatic latent image thus formed is developed by the use of a black toner held in a black developing apparatus 114Bk as a first developing apparatus, to form a black toner image; the developing apparatus being provided in a rotatable rotary unit 114. The black toner image formed on the photosensitive drum 111 is primarily transferred electrostatically onto an intermediate transfer drum 115 by the action of a transfer bias voltage applied to a conductive support of the intermediate transfer drum. Next, a second electrostatic latent image is formed on the surface of the photosensitive drum 111 in the same way as the above, and the rotary unit 114 is rotated to develop the second electrostatic latent image by the use of a yellow toner held in a yellow developing apparatus 114Y as a second developing apparatus, to form a yellow toner image. The yellow toner image is primarily transferred electrostatically onto the intermediate transfer drum 115 on which the black toner image has been transferred primarily. Similarly, third and fourth electrostatic latent images are formed and, rotating the rotary unit 114, they are developed sequentially by the use of a magenta toner held in a magenta developing apparatus 114M as a third developing apparatus and a cyan toner held in a cyan developing apparatus 114C as a fourth developing apparatus, respectively, and the magenta toner image and cyan toner image formed are primarily transferred sequentially. Thus, the respective color toner images are primarily transferred onto the intermediate transfer drum 115. The toner images primarily transferred as a multiple toner image onto the intermediate transfer drum 115 are secondarily one-time transferred electrostatically onto a recording medium P by the action of a transfer bias voltage applied from a second transfer means 118 positioned on the opposite side via the recording medium P. The multiple toner image secondarily transferred onto the recording medium P is heat-fixed to the recording medium P by means of a fixing assembly 113 having a heat roller 113*a* and a pressure roller 113*b*. Transfer residual toner remaining on the surface of the photosensitive drum 111 after transfer is collected by a cleaner having a cleaning blade coming in contact with the surface of the photosensitive drum 111, thus the photosensitive drum 111 is cleaned.

For the primary transfer from the photosensitive drum 111 to the intermediate transfer drum 115, a transfer electric current is formed by applying a bias from a power source (not shown) to the conductive support of the intermediate transfer drum 115 serving as a first transfer assembly, thus the toner images can be transferred.

The intermediate transfer drum 115 comprises a conductive support 115*a* which is a rigid body and an elastic layer 115*b* which covers its surface.

The conductive support 115*a* may be formed using a metal such as aluminum, iron, copper or stainless steel, or a conductive resin with carbon or metal particles dispersed therein. As its shape, it may be a cylinder, a cylinder through the center of which a shaft is passed, or a cylinder reinforced on its inside.

The elastic layer 115*b* may preferably be formed using, but not particularly limited to, an elastomer rubber including styrene-butadiene rubber, high styrene rubber, butadiene rubber, isoprene rubber, ethylene-propylene copolymer, nitrile butadiene rubber (NBR), chloroprene rubber, butyl rubber, silicone rubber, fluororubber, nitrile rubber, urethane rubber, acrylic rubber, epichlorohydrin rubber and norbornane rubber. Resins such as polyolefin resins, silicone resins, fluorine resins, polycarbonate resins, and copolymers or mixtures of any of these may also be used.

On the surface of the elastic layer, a surface layer may further be formed in which a highly lubricating and water-repellent lubricant powder has been dispersed in any desired binder.

There are no particular limitations on the lubricant. Preferably usable are various fluororubbers, fluoroelastomers, carbon fluorides comprising fluorine-bonded graphite, fluorine compounds such as polytetrafluoroethylene (PTFE), polyvinylidene fluoride (PVDF), ethylene-tetrafluoroethylene copolymer (ETFE) and tetrafluoroethylene-perfluoroalkyl vinyl ether copolymers (PFA), silicone compounds such as silicone resin particles, silicone rubbers and silicone elastomers, polyethylene (PE), polypropylene (PP), polystyrene (PS), acrylic resins, polyamide resins, phenol resins, and epoxy resins.

To the binder of the surface layer, a conducting agent may appropriately be added in order to control its resistance. The conducting agent may include various conductive inorganic particles, carbon black, ionic conducting agents, conductive resins and conductive-particle-dispersed resins.

The multiple toner image on the intermediate transfer drum 115 is secondarily one-time transferred onto the recording medium P by means of the second transfer means 118. Usable as the transfer means 118 is a non-contact electrostatic transfer means making use of a corona charging assembly, or a contact electrostatic transfer means making use of a transfer roller or a transfer belt.

As the fixing assembly 113, in place of the heat roller fixing means having a heat roller 113*a* and a pressure roller 113*b*, a film heat-fixing means may be used which heat-fixes the multiple toner image onto the recording medium P by heating a film coming in contact with the toner images on the recording medium P and thereby heating the toner images on the recording medium P.

In place of the intermediate transfer drum as the intermediate transfer member used in the image-forming apparatus shown in FIG. 8, an intermediate transfer belt may be used to one-time transfer the multiple toner image to the recording medium.

Using as a full-color image-forming apparatus having the above intermediate transfer member a remodeled machine of a full-color laser printer LBP-2260N (trade name; manufactured by CANON INC.) whose respective developing apparatus were so remodeled that the developing apparatus 1 of the non-magnetic one-component contact development system shown in FIG. 1 in the above Embodiment 1 was usable, a running test was made in which full-color images were continuously formed on 10,000 sheets. As the result, it was able to form good high-quality full-color images to the finish even in 10,000-sheet printing, without causing any separation in the developing roller.

The non-magnetic one-component yellow, cyan, magenta and black toners used in the respective developing apparatus were the same as those described in Embodiment 4.

Embodiment 6

As an image-forming apparatus according to a sixth embodiment of the present invention, an image-forming apparatus will be described below which has a transfer assembly through which a plurality of toner images are sequentially transferred to a transfer medium.

The image-forming apparatus according to the sixth embodiment of the present invention comprises;

(I) an image bearing member for holding thereon an electrostatic latent image;

(II) a charging assembly for charging the image bearing member primarily;

(III) an exposure assembly for forming the electrostatic latent image on the image bearing member having primarily been charged;

(IV) a plurality of developing apparatus each for developing the electrostatic latent image by the use of a non-magnetic toner to form a toner image; and (V) a transfer assembly for sequentially transferring to a transfer medium the toner image formed by each of the developing apparatus.

This developing apparatus comprises (i) a toner hopper for holding therein a non-magnetic one-component toner for developing the electrostatic latent image formed on the surface of the image bearing member, and (ii) a developing roller for transporting the non-magnetic one-component toner held in the toner hopper, while causing the toner to adhere to the roller surface. As this developing roller, the developing roller of the present invention as described above is used.

Figure 9:
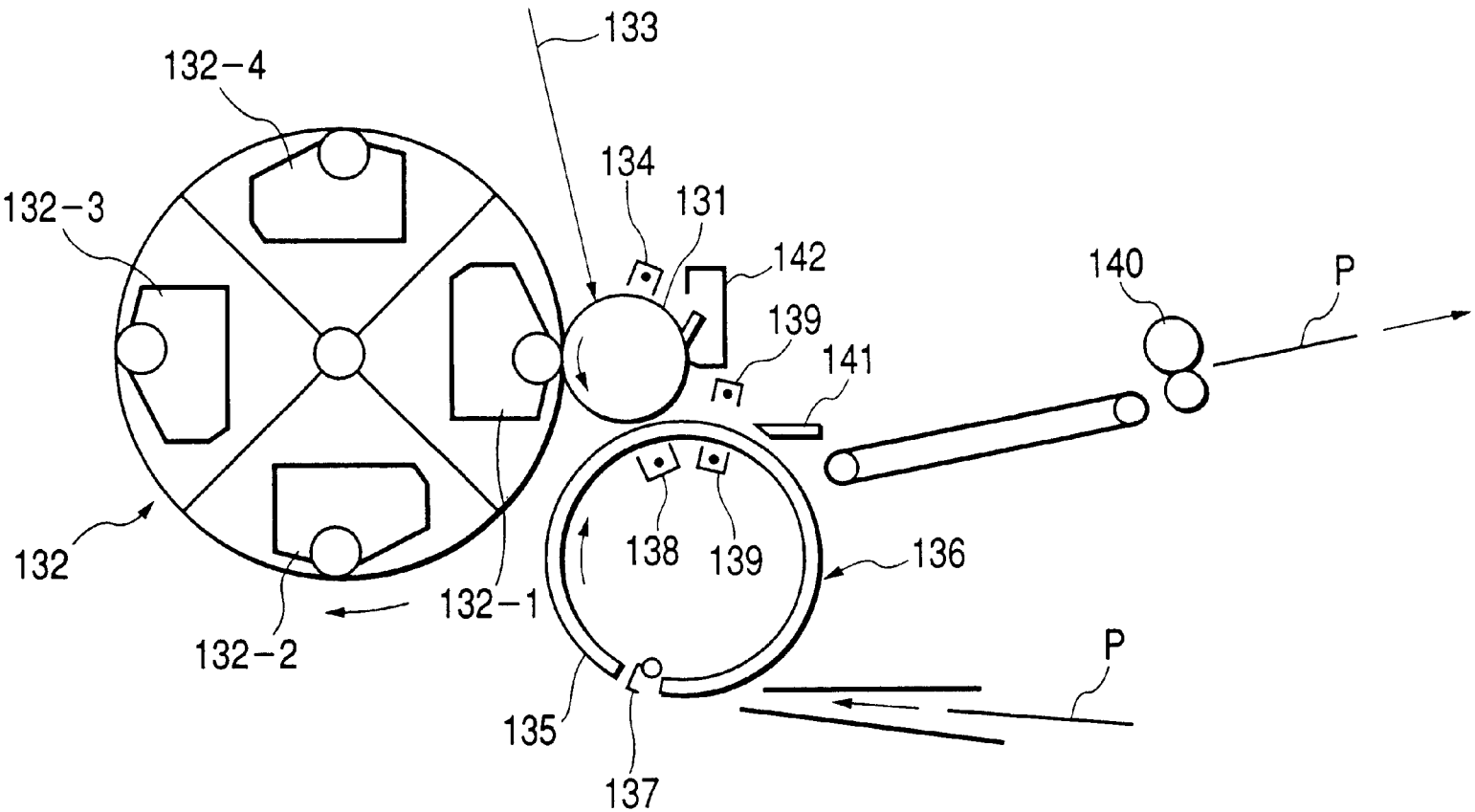
FIG. 9 illustrates an example of an image-forming apparatus according to Embodiment 6 of the present invention.

FIG. 9 schematically illustrates an image-forming apparatus according to the sixth embodiment of the present invention in which a plurality of toner images are sequentially transferred to a recording medium held on a transfer drum, to form a multiple toner image.

An electrostatic latent image formed on a latent image bearing member photosensitive drum 131 through a latent-image-forming means exposure means 133 is rendered visible by a one-component developer having a first non-magnetic color toner held in a developing apparatus 132-1 serving as a developing means, attached to a rotary developing unit 132 which is rotated in the direction of the arrow. The color toner image (the first color) thus formed on the photosensitive drum 131 is transferred by means of a transfer charging assembly 138 to a transfer medium, a recording medium P, held on a transfer drum 136 by a gripper 137.

In the transfer charging assembly 138, a corona charging assembly or a contact transfer charging assembly is used. In the case when the corona charging assembly is used in the transfer charging assembly 138, a voltage of −10 kV to +10 kV is applied, and a transfer electric current is set at −500 μA to +500 μA. On the periphery of the transfer drum 136, a holding member is provided. This holding member is formed of a film-like dielectric sheet such as polyvinylidene fluoride resin film or polyethylene terephthalate film. For example, a sheet with a thickness of from 100 μm to 200 μm and a volume resistivity of from $10^{12}$ to $10^{14}$ Ω·cm is used.

Next, for the second color, the rotary developing unit is rotated until a developing apparatus 132-2 faces the photosensitive drum 131. Then, a second-color latent image is developed by a one-component developer having a second non-magnetic color toner held in the developing apparatus 132-2, and the color toner image thus formed is also transferred superimposingly to the same transfer medium as the above, the recording medium P.

Similar operation is also repeated for the third and fourth colors by means of developing apparatus 132-3 and 132-4. Thus, the transfer drum 136 is rotated given times while the transfer medium, the recording medium P, is kept being gripped thereon, so that the toner images corresponding to the number of given colors are multiple-transferred to the recording medium. Transfer electric currents for electrostatic transfer may preferably be made greater in the order of first color, second color, third color and fourth color so that the toners may less remain on the photosensitive drum after transfer.

Too high transfer electric currents are not preferable because the images being transferred may be disordered.

The recording medium P on which the multiple transfer has been completed is separated from the transfer drum 136 by means of a separation charging assembly 139. Then the toner images held thereon are fixed by means of a heat-pressure roller fixing assembly 140 having a web impregnated with silicone oil, and color-additively mixed at the time of fixing, whereupon a full-color copied image is formed.

In the case of an apparatus in which toners are replenished to developing assemblies, replenishing toners to be fed to the developing apparatus 132-1 to 132-4 are transported in certain quantities in accordance with replenishing signals, from a replenishing hopper provided for each color, through a toner transport cable to a toner replenishing cylinder provided at the center of the rotary developing unit 132, and are sent to the respective developing apparatus.

Using as a full-color image-forming apparatus having the above transfer drum a remodeled machine of a full-color copying machine CLC-500 (trade name; manufactured by CANON INC.) whose respective developing apparatus were so remodeled that the developing apparatus 1 of the non-magnetic one-component contact development system shown in FIG. 1 in the above Embodiment 1 was usable, a running test was made in which full-color images were continuously formed on 40,000 sheets. As the result, it was able to form good high-quality full-color images even in 40,000-sheet printing, without causing any separation in the developing roller.

The non-magnetic one-component yellow, cyan, magenta and black toners used in the respective developing apparatus were the same as those described in Embodiment 4.

As having been described above, according to the present invention, the elastic intermediate layer having a superior adhesion is provided between the charge-providing layer and the base layer. This makes it possible attain a sufficiently high adhesion of the charge-providing layer even when the LTV silicone rubber, having a low surface energy, is used as a material for the base layer, and also makes it possible to obtain a low-hardness developing roller having a low coefficient of dynamic friction and a high charge-providing performance which has ever been difficult to obtain. In addition, where the base layer is formed in a porous structure, materials can be selected in a wider range.

What is claimed is:

1. A developing roller for electrophotography, comprising:

a conductive mandrel;

a charge-providing layer having a charge-providing performance to a non-magnetic, one-component toner, formed at a surface of said developing roller;

a base layer having an elasticity, formed at a position nearer to a position of said mandrel than a position of said charge-providing layer; and an elastic intermediate layer formed at a position between the positions of said base layer and said charge-providing layer, wherein a contact angle to water of said intermediate layer is smaller than a contact angle to water of said base layer.

2. The developing roller according to claim 1, wherein said developing roller has a net resistivity in a range of $1\times10^4$ Ω to $1\times10^8$ Ω.

3. The developing roller according to claim 1, wherein said developing roller has a net resistivity in a range of $1\times10^4$ Ω to $1\times10^6$ Ω.

4. The developing roller according to claim 1, wherein said base layer has a volume resistivity in a range of $1\times10^4$ Ω·cm to $1\times10^8$ Ω·cm.

5. The developing roller according to claim 1, wherein said intermediate layer has a volume resistivity in a range of $1\times10^4$ Ω·cm to $1\times10^8$ Ω·cm.

6. The developing roller according to claim 1, wherein said charge-providing layer has a volume resistivity in a range of $1\times10^4$ Ω·cm to $1\times10^8$ Ω·cm.

7. The developing roller according to claim 1, wherein said developing roller has an Asker-C hardness Hr of 50 degrees or below.

8. The developing roller according to claim 1, wherein said developing roller has an Asker-C hardness Hr in a range of 20 degrees to 50 degrees.

9. The developing roller according to claim 1, wherein said base layer has an Asker-C hardness Hb in a range of 15 degrees to 50 degrees.

10. The developing roller according to claim 1, wherein said intermediate layer has an Asker-C hardness Hm in a range of 20 degrees to 50 degrees.

11. The developing roller according to claim 1, wherein said developing roller has an Asker-C hardness Hr, said base layer has an Asker-C hardness Hb, and said intermediate layer has an Asker-C hardness Hm, which satisfy the following relationships:

$$Hr \geqq Hb$$

and $$Hm \geqq Hb.$$

12. The developing roller according to claim 1, wherein said developing roller has an Asker-C hardness Hr, said base layer has an Asker-C hardness Hb, and said intermediate layer has an Asker-C hardness Hm, which satisfy the following relationship:

$$Hr \geqq Hm \geqq Hb.$$

13. The developing roller according to claim 1, wherein said developing roller has an Asker-C hardness Hr, said base layer has an Asker-C hardness Hb, and said intermediate layer has an Asker-C hardness Hm, which satisfy the following relationship:

$$Hr \geqq Hm > Hb.$$

14. The developing roller according to claim 1, wherein said base layer is a rubber layer.

15. The developing roller according to claim 14, wherein said rubber layer is a solid rubber layer composed primarily of silicone rubber.

16. The developing roller according to claim 1, wherein said base layer is composed of a material having a porous structure.

17. The developing roller according to claim 16, wherein said base layer is a foamed rubber layer composed primarily of rubber selected from the group consisting of silicone rubber, ethylene-propylene-diene copolymer rubber, urethane rubber, and nitrile-butadiene rubber.

18. The developing roller according to claim 16, wherein said base layer is a foamed rubber layer composed primarily of ethylene-propylene-diene copolymer rubber.

19. The developing roller according to claim 1, wherein said intermediate layer is composed primarily of rubber selected from the group consisting of ethylene-propylene-diene copolymer rubber, urethane rubber, and nitrile-butadiene rubber.

20. The developing roller according to claim 1, wherein said intermediate layer is a solid rubber layer composed primarily of silicone rubber.

21. The developing roller according to claim 1, wherein said intermediate layer is a solid rubber layer composed primarily of nitrile-butadiene rubber.

22. The developing roller according to claim 1, wherein said base layer is a solid rubber layer composed primarily of silicone rubber, and wherein said intermediate layer is a solid rubber layer composed primarily of silicone rubber.

23. The developing roller according to claim 1, wherein said base layer is a foamed rubber layer composed primarily of ethylene-propylene-diene copolymer rubber, and wherein said intermediate layer is a solid rubber layer composed primarily of nitrile-butadiene rubber.

24. The developing roller according to claim 1, wherein said charge-providing layer is bonded to said intermediate layer by means of an adhesive.

25. The developing roller according to claim 1, wherein said charge-providing layer is composed primarily of resin having a charge polarity opposite to a charge polarity of the non-magnetic, one-component toner.

26. The developing roller according to claim 1, wherein said charge-providing layer is composed primarily of resin selected from the group consisting of polyamide resin, acrylic urethane resin, acrylic polyester urethane resin, and acrylic silicone resin.

27. A developing apparatus comprising:

a toner hopper for containing therein a non-magnetic, one-component toner for developing an electrostatic latent image formed on a surface of an image bearing member; and a developing roller for transporting the non-magnetic, one-component toner from said toner hopper, while causing the toner to adhere to a surface of said developing roller, wherein said developing roller includes:

a conductive mandrel;

a charge-providing layer having a charge-providing performance to the toner, formed at said surface of said developing roller;

a base layer having an elasticity, formed at a position nearer to a position of said mandrel than a position of said charge-providing layer; and an elastic intermediate layer formed at a position between positions of said base layer and said charge-providing layer, wherein a contact angle to water of said intermediate layer is smaller than a contact angle to water of said base layer.

28. The developing apparatus according to claim 27, wherein said developing roller has a net resistivity in a range of $1\times10^4$ Ω to $1\times10^8$ Ω.

29. The developing apparatus according to claim 27, wherein said developing roller has a net resistivity in a range of $1\times10^4$ Ω to $1\times10^6$ Ω.

30. The developing apparatus according to claim 27, wherein said base layer has a volume resistivity in a range of $1\times10^4$ Ω·cm to $1\times10^8$ Ω·cm.

31. The developing apparatus according to claim 27, wherein said intermediate layer has a volume resistivity in a range of $1\times10^4$ Ω·cm to $1\times10^8$ Ω·cm.

32. The developing apparatus according to claim 27, wherein said charge-providing layer has a volume resistivity in a range of $1\times10^4$ Ω·cm to $1\times10^8$Ω·cm.

33. The developing roller according to claim 27, wherein said developing roller has an Asker-C hardness Hr, of 50 degrees or below.

34. The developing apparatus according to claim 27, wherein said developing roller has an Asker-C hardness Hr in a range of 20 degrees to 50 degrees.

35. The developing apparatus according to claim 27, wherein said base layer has an Asker-C hardness Hb in a range of 15 degrees to 50 degrees.

36. The developing apparatus according to claim 27, wherein said intermediate layer has an Asker-C hardness Hm in a range of 20 degrees to 50 degrees.

37. The developing apparatus according to claim 27, wherein said developing roller has an Asker-C hardness Hr, said base layer has an Asker-C hardness Hb, and said intermediate layer has an Asker-C hardness Hm, which satisfy the following relationships:

$$Hr \geqq Hb$$

and $$Hm \geqq Hb.$$

38. The developing apparatus according to claim 27, wherein said developing roller has an Asker-C hardness Hr, said base layer has an Asker-C hardness Hb, and said intermediate layer has an Asker-C hardness Hm, which satisfy the following relationship:

$$Hr \geqq Hm \geqq Hb.$$

39. The developing apparatus according to claim 27, wherein said developing roller has an Asker-C hardness Hr, said base layer has an Asker-C hardness Hb, and said intermediate layer has an Asker-C hardness Hm, which satisfy the following relationship:

$$Hr \geqq Hs > Hb.$$

40. The developing apparatus according to claim 27, wherein said base layer is rubber layer.

41. The developing apparatus according to claim 40, wherein said rubber layer is composed primarily of solid silicone rubber.

42. The developing apparatus according to claim 27, wherein said base layer is composed of a material having a porous structure.

43. The developing apparatus according to claim 42, wherein said base layer is a foamed rubber layer composed primarily of rubber selected from the group consisting of silicone rubber, ethylene-propylene-diene copolymer rubber, urethane rubber, and nitrile-butadiene rubber.

44. The developing apparatus according to claim 42, wherein said base layer is a foamed rubber layer composed primarily of ethylene-propylene-diene copolymer rubber.

45. The developing apparatus according to claim 27, wherein said intermediate layer is composed primarily of rubber selected from the group consisting of ethylene-propylene-diene copolymer rubber, urethane rubber, and nitrile-butadiene rubber.

46. The developing apparatus according to claim 27, wherein said intermediate layer is a solid rubber layer composed primarily of silicone rubber.

47. The developing apparatus according to claim 27, wherein said intermediate layer is a solid rubber layer composed primarily of nitrile-butadiene rubber.

48. The developing apparatus according to claim 27, wherein, said base layer is a solid rubber layer composed primarily of silicone rubber, and wherein said intermediate layer is a solid rubber layer composed primarily of silicone rubber.

49. The developing apparatus according to claim 27, wherein, said base layer is a foamed rubber layer composed primarily of ethylene-propylene-diene copolymer rubber, and wherein said intermediate layer is a solid rubber layer composed primarily of nitrile-butadiene rubber.

50. The developing apparatus according to claim 27, wherein said charge-providing layer is bonded to said intermediate layer by means of an adhesive.

51. The developing apparatus according to claim 27, wherein said charge-providing layer is composed primarily of resin having a charge polarity opposite to a charge polarity of the non-magnetic, one-component toner.

52. The developing apparatus according to claim 27, wherein said charge-providing layer is composed primarily of resin selected from the group consisting of polyamide resin, acrylic urethane resin, acrylic polyester urethane resin, and acrylic silicone resin.

53. The developing apparatus according to claim 27, further comprising a toner feed roller for feeding to said developing roller the non-magnetic, one-component toner contained in said toner hopper, and said toner feed roller is in contact with said surface of said developing roller.

54. The developing apparatus according to claim 53, further comprising an agitation means for agitating the non-magnetic, one-component toner contained in said toner hopper and transporting and feeding the toner to a side of said toner feed roller.

55. The developing apparatus according to claim 27, further comprising a developing blade for regulating a coat quantity and a charge quantity of the non-magnetic, one-component toner on said developing roller, and said developing blade is disposed so as to come into contact with said surface of said developing roller.

56. The developing apparatus according to claim 27, wherein said developing roller is disposed so as to come into contact with said surface of said image bearing member.

57. The developing apparatus according to claim 56, wherein a development bias voltage is applied to said developing roller at a time of a development operation.

58. The developing apparatus according to claim 57, wherein the development bias voltage is a direct-current bias voltage.

59. The developing apparatus according to claim 56, wherein said developing roller is rotated at a speed so as to have a difference in speed from a speed of said surface of said image bearing member.

60. The developing apparatus according to claim 27, wherein the non-magnetic, one-component toner has a shape factor SF-1 in a range of 100 to 160 and a shape factor SF-2 in a range of 100 to 140.

61. The developing apparatus according to claim 60, wherein the non-magnetic, one-component toner is obtained by subjecting a polymerizable monomer composition having at least a polymerizable monomer and a colorant, to suspension polymerization in an aqueous medium.

62. The developing apparatus according to claim 27, wherein the non-magnetic, one-component toner includes a core/shell structure in which a core composed primarily of a wax having a melting point in a range of 40° C. to 90° C. and the core is covered with a shell composed primarily of resin.

63. The developing apparatus according to claim 27, wherein the non-magnetic, one-component toner includes a core/shell structure in which a core composed primarily of a wax having a melting point in a range of 40° C. to 90° C. is covered with a shell composed primarily of resin, and has a shape factor SF-1 in a range of 100 to 160 and a shape factor SF-2 in a range of 100 to 140.

64. The developing apparatus according to claim 63, wherein the non-magnetic, one-component toner is obtained by subjecting a polymerizable monomer composition having at least a polymerizable monomer, a colorant and the wax, to suspension polymerization in an aqueous medium.

65. The developing apparatus according to claim 27, wherein an external additive is externally added to the non-magnetic, one-component toner.

66. The developing apparatus according to claim 65, wherein said additive comprises a hydrophobic inorganic fine powder.

67. An apparatus unit detachably mountable to the main body of an image-forming apparatus, comprising:

a toner hopper for containing therein a non-magnetic, one-component toner for developing an electrostatic latent image formed on a surface of an image bearing member; and a developing roller for transporting the non-magnetic, one-component toner contained in said toner hopper, while causing the toner to adhere to a surface of said developing roller, wherein said developing roller includes:

a conductive mandrel;

a charge-providing layer having a charge-providing performance to the toner, formed at said surface of said developing roller;

a base layer having an elasticity, formed at a position nearer to a position of said mandrel than a position of said charge-providing layer; and an elastic intermediate layer formed at a position between positions of said base layer and said charge-providing layer, wherein a contact angle to water of said intermediate layer is smaller than a contact angle to water of said base layer.

68. The apparatus unit according to claim 67, wherein said developing roller has a net resistivity in a range of $1\times10^4$ Ω to $1\times10^8$ Ω.

69. The apparatus unit according to claim 67, wherein said developing roller has a net resistivity in a range of $1\times10^4$ Ω to $1\times10^6$ Ω.

70. The apparatus unit according to claim 67, wherein said base layer has a volume resistivity in a range of $1\times10^4$ Ω·cm to $1\times10^8$ Ω·cm.

71. The apparatus unit according to claim 67, wherein said intermediate layer has a volume resistivity in a range of $1\times10^4$ Ω·cm to $1\times10^8$ Ω·cm.

72. The apparatus unit according to claim 67, wherein said charge-providing layer has a volume resistivity in a range of $1\times10^4$ Ω·cm to $1\times10^8$ Ω·cm.

73. The apparatus unit according to claim 67, wherein said developing roller has an Asker-C hardness Hr in a range of 50 degrees or below.

74. The apparatus unit according to claim 67, wherein said developing roller has an Asker-C hardness Hr in a range of 20 degrees to 50 degrees.

75. The apparatus unit according to claim 67, wherein said base layer has an Asker-C hardness Hb in a range of 15 degrees to 50 degrees.

76. The apparatus unit according to claim 67, wherein said intermediate layer has an Asker-C hardness Hm in a range of 20 degrees to 50 degrees.

77. The apparatus unit according to claim 67, wherein said developing roller has an Asker-C hardness Hr, said base layer has an Asker-C hardness Hb, and said intermediate layer has an Asker-C hardness Hm, which satisfy the following relationships:

$$Hr \geqq Hb$$

and $$Hm \geqq Hb.$$

78. The apparatus unit according to claim 67, wherein said developing roller has an Asker-C hardness Hr, said base layer has an Asker-C hardness Hb, and said intermediate layer has an Asker-C hardness Hm, which satisfy the following relationship:

$$Hr \geqq Hm \geqq Hb.$$

79. The apparatus unit according to claim 67, wherein said developing roller has an Asker-C hardness Hr, said base layer has an Asker-C hardness Hb, and said intermediate layer has an Asker-C hardness Hm, which satisfy the following relationship:

$$Hr \geqq Hm > Hb.$$

80. The apparatus unit according to claim 67, wherein said base layer is a rubber layer.

81. The apparatus unit according to claim 80, wherein said rubber layer is a solid rubber layer composed primarily of silicone rubber.

82. The apparatus unit according to claim 67, wherein said base layer is composed of a material having a porous structure.

83. The apparatus unit according to claim 82, wherein said base layer is a foamed rubber layer composed primarily of rubber selected from the group consisting of silicone rubber, ethylene-propylene-diene copolymer rubber, urethane rubber, and nitrile-butadiene rubber.

84. The apparatus unit according to claim 82, wherein said base layer is a foamed rubber layer composed primarily of ethylene-propylene-diene copolymer rubber.

85. The apparatus unit according to claim 67, wherein said intermediate layer is composed primarily of rubber selected from the group consisting of ethylene-propylene-diene copolymer rubber, urethane rubber, and nitrile-butadiene rubber.

86. The apparatus unit according to claim 67, wherein said intermediate layer is a solid rubber layer composed primarily of silicone rubber.

87. The apparatus unit according to claim 67, wherein said intermediate layer is a solid rubber layer composed primarily of nitrile-butadiene rubber.

88. The apparatus unit according to claim 67, wherein said base layer is a solid rubber layer composed primarily of silicone rubber, and wherein said intermediate layer is a solid rubber layer composed primarily of silicone rubber.

89. The apparatus unit according to claim 67, wherein, said base layer is a foamed rubber layer composed primarily of ethylene-propylene-diene copolymer rubber, and wherein said intermediate layer is a solid rubber layer composed primarily of nitrile-butadiene rubber.

90. The apparatus unit according to claim 67, wherein said charge-providing layer is bonded to said intermediate layer by means of an adhesive.

91. The apparatus unit according to claim 67, wherein said charge-providing layer is composed primarily of resin having a charge polarity opposite to a charge polarity of the non-magnetic, one-component toner.

92. The apparatus unit according to claim 67, wherein said charge-providing layer is composed primarily of resin selected from the group consisting of polyamide resin, acrylic urethane resin, acrylic polyester urethane resin, and acrylic silicone resin.

93. The apparatus unit according to claim 67, further comprising a toner feed roller for feeding to said developing roller the non-magnetic, one-component toner contained in said toner hopper, and said toner feed roller is disposed so as to contact with said surface of said developing roller.

94. The apparatus unit according to claim 93, further comprising an agitation means for agitating the non-magnetic, one-component toner contained in said toner hopper and transporting and feeding the toner to a side of said toner feed roller.

95. The apparatus unit according to claim 67, further comprising a developing blade for regulating a coat quantity and a charge quantity of the non-magnetic, one-component toner on said developing roller, and said developing blade is disposed so as to contact with said surface of said developing roller.

96. The apparatus unit according to claim 67, wherein said developing roller is disposed so as to come into contact with said surface of said image bearing member.

97. The apparatus unit according to claim 96, wherein a development bias voltage is applied to said developing roller at a time of development.

98. The apparatus unit according to claim 97, wherein the development bias voltage is a direct-current bias voltage.

99. The apparatus unit according to claim 96, wherein said developing roller is rotated at a speed so as to have a difference in a circumferential speed from a circumferential speed of the surface of said image bearing member.

100. The apparatus unit according to claim 67, wherein said image bearing member is provided as a unit.

101. The apparatus unit according to claim 100, wherein said image bearing member includes an electrophotographic photosensitive drum.

102. The apparatus unit according to claim 67, wherein said image bearing member and a charging assembly for charging said image bearing member primarily are provided as a unit.

103. The apparatus unit according to claim 102, wherein said image bearing member includes an electrophotographic photosensitive drum.

104. The apparatus unit according to claim 67, wherein said non-magnetic, one-component toner has a shape factor SF-1 in a range of 100 to 160 and a shape factor SF-2 in a range of 100 to 140.

105. The apparatus unit according to claim 104, wherein the non-magnetic, one-component toner is obtained by subjecting a polymerizable monomer composition having at least a polymerizable monomer and a colorant, to suspension polymerization in an aqueous medium.

106. The apparatus unit according to claim 67, wherein the non-magnetic, one-component toner includes a core/shell structure in which a core composed primarily of a wax having a melting point in a range of 40° C. to 90° C. and the core is covered with a shell composed primarily of resin.

107. The apparatus unit according to claim 67, wherein the non-magnetic, one-component toner has a core/shell structure in which a core composed primarily of a wax having a melting point in a range of 40° C. to 90° C. is covered with a shell composed primarily of resin and has a shape factor SF-1 in a range of 100 to 160 and a shape factor SF-2 in a range of 100 to 140.

108. The apparatus unit according to claim 107, wherein the non-magnetic, one-component toner is obtained by subjecting a polymerizable monomer composition having at least a polymerizable monomer, a colorant and the wax, to suspension polymerization in an aqueous medium.

109. The apparatus unit according to claim 67, wherein an additive is externally added to the non-magnetic, one-component toner.

110. The apparatus unit according to claim 109, wherein said additive comprises a hydrophobic, inorganic fine powder.

111. An image-forming apparatus comprising:

an image bearing member for bearing thereon an electrostatic latent image;

a charging assembly for primarily charging said image bearing member;

an exposure assembly for forming the electrostatic latent image on a surface of said image bearing member having been primarily charged;

a plurality of developing apparatuses, each for developing the electrostatic latent image by the use of a non-magnetic toner to form a toner image;

an intermediate transfer member for sequentially transferring thereto the toner image formed by each of said plurality of developing apparatuses to form a multiple toner image; and a transfer assembly for transferring to a transfer medium at one time the multiple toner image transferred to said intermediate transfer member, wherein each of said plurality of developing apparatuses includes:

a toner hopper for containing therein a non-magnetic, one-component toner for developing the electrostatic latent image formed on said surface of said image bearing member; and a developing roller for transporting the non-magnetic, one-component toner contained in said toner hopper, while causing the toner to adhere to a surface of said developing roller, wherein said developing roller includes:

a conductive mandrel;

a charge-providing layer having a charge-providing performance to the toner, formed on said surface of said developing roller;

a base layer having an elasticity, formed at a position nearer to a position of said mandrel than a position of said charge-providing layer; and an elastic intermediate layer formed at a position between the positions of said base layer and said charge-providing layer, wherein a contact angle to water of said intermediate layer is smaller than a contact angle to water of said base layer.

112. The image-forming apparatus according to claim 111, wherein each of said plurality of developing apparatuses is the developing apparatus according to any one of claims 28 to 66.

113. An image-forming apparatus comprising:

an image bearing member for bearing thereon an electrostatic latent image;

a charging assembly for primarily charging said image bearing member;

an exposure assembly for forming the electrostatic latent image on a surface of said image bearing member having been primarily charged;

a plurality of developing apparatuses, each for developing the electrostatic latent image by the use of a non-magnetic toner to form a toner image; and a transfer assembly for sequentially transferring to a transfer medium the toner image formed by each of said plurality of developing apparatuses, wherein each of said plurality of developing apparatuses includes:

a toner hopper for containing therein a non-magnetic, one-component toner for developing the electrostatic latent image formed on said surface of said image bearing member; and a developing roller for transporting the non-magnetic, one-component toner contained in said toner hopper, while causing the toner to adhere to a surface of said developing roller, wherein said developing roller includes:

a conductive mandrel;

a charge-providing layer having a charge-providing performance to the toner, formed on said surface of said developing roller;

a base layer having an elasticity, formed at a position nearer to a position of said mandrel than a position of said charge-providing layer; and an elastic intermediate layer formed at a position between the positions of said base layer and said charge-providing layer, wherein a contact angle to water of said intermediate layer is smaller than a contact angle to water of said base layer.

114. The image-forming apparatus according to claim 113, wherein each of said developing apparatuses is the developing apparatus according to any one of claims 28 to 66.

115. The image-forming apparatus comprising a plurality of image-forming units each including;

an image bearing member for bearing thereon an electrostatic latent image;

a charging assembly for primarily charging the image bearing member;

an exposure assembly for forming the electrostatic latent image on a surface of said image bearing member having been primarily charged; and a plurality of developing apparatuses, each for developing the electrostatic latent image by the use of a non-magnetic toner to form a toner image, wherein each of said plurality of developing apparatuses includes:

a toner hopper for containing therein a non-magnetic, one-component toner for developing an electrostatic latent image formed on said surface of said image bearing member; and a developing roller for transporting the non-magnetic, one-component toner contained in said toner hopper, while causing the toner to adhere to a surface of said developing roller, wherein said developing roller includes:

a conductive mandrel;

a charge-providing layer having a charge-providing performance to the toner, formed on said surface of said developing roller;

a base layer having an elasticity, formed at a position nearer to a position of said mandrel than a position of said charge-providing layer; and an elastic intermediate layer formed at a position between the positions of said base layer and said charge-providing layer, wherein a contact angle to water of said intermediate layer is smaller than a contact angle to water of said base layer; and a transfer assembly for sequentially transferring to a transfer medium the toner images formed by the plurality of the image-forming units.

* * * * *

UNITED STATES PATENT AND TRADEMARK OFFICE

CERTIFICATE OF CORRECTION

PATENT NO. : 6,714,754 B2
DATED : March 30, 2004
INVENTOR(S) : Yukihiro Ozeki et al.

It is certified that error appears in the above-identified patent and that said Letters Patent is hereby corrected as shown below:

Title page,
Item [75], Inventors, "Yukihiro Ozeki, Kanagawa-ken (JP); Katsuhiro Sakaizawa, Shizuoka-ken (JP); Makoto Nonomura, Kanagawa-ken (JP); Manami Sekiguchi, Shizuoka-ken (JP)" should read -- Yukihiro Ozeki, Yokohama (JP); Katsuhiro Sakaizawa, Numazu (JP); Makoto Nonomura, Kawasaki (JP); Manami Sekiguchi, Mishima (JP) --.
Item [56], References Cited, U.S. PATENT DOCUMENTS, "No. 63212944." should read -- 63-212944. --.

Column 1,
Line 32, "ways" should read -- way --; and
Line 41, "toners," should read -- toners are used, --.

Column 2,
Line 41, "triboelctically" should read -- triboelectrically --; and
Line 64, "less occur." should read -- occur less. --.

Column 4,
Line 29, "tends" should read -- tend --.

Column 11,
Line 19, "degrees," should read -- degrees, --; and
Line 22, "less deteriorate." should read -- deteriorate less. --.

Column 12,
Line 58, "less deteriorate," should read -- deteriorate less. --.

Column 14,
Line 14, "becomes" should read -- become --; and
Line 37, "toner" should read -- toners --.

Column 16,
Line 37, "and" should read -- or --.

Column 17,
Line 31, "peripheral" (first occurrence) should be deleted.

UNITED STATES PATENT AND TRADEMARK OFFICE

CERTIFICATE OF CORRECTION

PATENT NO. : 6,714,754 B2
DATED : March 30, 2004
INVENTOR(S) : Yukihiro Ozeki et al.

It is certified that error appears in the above-identified patent and that said Letters Patent is hereby corrected as shown below:

Column 18,
Line 37, “to” (second occurrence) should read -- of --.

Column 19,
Line 36, “Sf-1” should read -- SF-1 --.

Column 20,
Line 25, “K.K.)” should read -- K.K.). --; and
Line 61, “degrees,” should read -- degrees, having an NBR solid rubber containing conductive particles and having a contact angle to water of 70 degrees, --.

Column 21,
Line 2, “other each” should read -- each other --.

Column 23,
Line 56, “power” should read -- powder --.

Column 27,
Line 29, “less remain” should read -- remain less --; and
Line 38, “color-additively” should read -- color-additive --.

Column 30,
Line 34, “roller” should read -- apparatus --; and
Line 35, “Hr,” should read -- Hr --.

Column 31,
Line 6, “rubber” should read -- a rubber --.

Column 33,
Line 22, “in a range” should be deleted.

UNITED STATES PATENT AND TRADEMARK OFFICE

CERTIFICATE OF CORRECTION

PATENT NO. : 6,714,754 B2
DATED : March 30, 2004
INVENTOR(S) : Yukihiro Ozeki et al.

It is certified that error appears in the above-identified patent and that said Letters Patent is hereby corrected as shown below:

Column 34,
Line 24, “wherein,” should read -- wherein --.

Column 37,
Line 1, “The” should read -- An --; and “comprising” should read -- comprising: --; and
Line 2, “including;” should read -- including: --.

Signed and Sealed this

Fifth Day of October, 2004

JON W. DUDAS
*Director of the United States Patent and Trademark Office*